US007517077B2

(12) United States Patent
Ishii et al.

(10) Patent No.: US 7,517,077 B2
(45) Date of Patent: Apr. 14, 2009

(54) MEDIUM TRANSPORTING DEVICE AND RECORDING APPARATUS INCORPORATING WITH THE SAME

(75) Inventors: Takayuki Ishii, Nagano (JP); Shin Genta, Nagano (JP); Kazumi Kamoi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 83 days.

(21) Appl. No.: 10/932,306

(22) Filed: Sep. 2, 2004

(65) Prior Publication Data

US 2005/0117010 A1 Jun. 2, 2005

(30) Foreign Application Priority Data

| | | |
|---|---|---|
| Sep. 2, 2003 | (JP) | P2003-309827 |
| Feb. 24, 2004 | (JP) | P2004-048153 |
| Mar. 9, 2004 | (JP) | P2004-065755 |
| Aug. 23, 2004 | (JP) | P2004-242566 |
| Aug. 23, 2004 | (JP) | P2004-242567 |
| Aug. 23, 2004 | (JP) | P2004-242568 |

(51) Int. Cl.

| | |
|---|---|
| ***B41J 11/44*** | (2006.01) |
| ***B41J 29/38*** | (2006.01) |
| *B41J 13/03* | (2006.01) |
| *B41J 13/00* | (2006.01) |

(52) U.S. Cl. ..... 347/104; 400/76; 400/636; 271/265.01; 271/272

(58) Field of Classification Search ..... None
See application file for complete search history.

(56) References Cited

U.S. PATENT DOCUMENTS

| | | | | |
|---|---|---|---|---|
| 4,420,151 | A * | 12/1983 | Kobayashi | 271/263 |
| 5,674,019 | A * | 10/1997 | Munakata et al. | 400/568 |
| 6,168,333 | B1 * | 1/2001 | Merz et al. | 400/634 |
| 6,287,033 | B1 * | 9/2001 | Hatakeyama et al. | 400/636 |
| 6,293,669 | B1 * | 9/2001 | Uchida | 347/104 |
| 6,520,700 | B1 * | 2/2003 | Iwata | 400/582 |
| 2003/0068070 | A1 * | 4/2003 | Dimeski | 382/101 |

FOREIGN PATENT DOCUMENTS

| | | | |
|---|---|---|---|
| JP | 61130150 | A * | 6/1986 |
| JP | 01192647 | A * | 8/1989 |
| JP | 7-304222 | A | 11/1995 |
| JP | 09040218 | A * | 2/1997 |
| JP | 09323844 | A * | 12/1997 |
| JP | 2000203009 | A * | 7/2000 |
| JP | 2002-273956 | A | 9/2002 |
| JP | 2003-65798 | A | 3/2003 |
| WO | WO 03064164 | A1 * | 8/2003 |

* cited by examiner

*Primary Examiner*—Daniel J Colilla
(74) *Attorney, Agent, or Firm*—Sughrue Mion, PLLC

(57) ABSTRACT

A liquid ejection head is operable to eject a liquid droplet toward a medium at a liquid ejection point A first roller transports the medium toward the liquid ejection point. A second roller ejects the medium transported from the liquid ejection point to the outside of the apparatus. At least one detection roller is directly brought into contact with the medium and is rotated in accordance with the transportation of the medium, the at least one detection roller being disposed in the vicinity of at least one of the first roller and the second roller. A detector detects a rotation amount of the detection roller. A controller controls the transportation of the medium in accordance with the rotation amount.

39 Claims, 25 Drawing Sheets

MEDIUM TRANSPORTING DEVICE AND RECORDING APPARATUS INCORPORATING WITH THE SAME

BACKGROUND OF THE INVENTION

The present invention relates to a medium transporting device that transports a medium and a recording apparatus incorporating the medium transporting device.

A printer, one type of recording apparatus, is equipped with a medium transporting device including a drive roller and a follower roller that together pinch and transport a sheet of paper used as a recording medium to a recording section, and a ejection roller and a spur that together pinch and transport the sheet of paper to a discharge portion. The medium transporting device is provided with a detector to detect a quantity of rotations of the drive roller, and a quantity of rotations of the drive roller is controlled by feeding back a detection signal from the detector (see Japanese Patent Publication No. 7-304222A). Another medium transporting device is provided with a reader to optically read a test pattern that has been provided previously on a sheet of paper, and transportation of a sheet of paper is controlled by calculating a correction value for a quantity of transportation of the sheet of paper on the basis of a read signal from the reader (see Japanese Patent Publication No. 2002-273956A).

The former medium transporting device, however, is not able to control transportation errors occurring beyond the detector, that is, eccentric errors of the drive roller, errors of the diameter of the drive roller, slipping errors between the drive roller and a sheet of paper, etc. In addition, once the trailing end of a sheet of paper is released from pinching between the drive roller and the follower roller, the sheet of paper is transported by being pinched between the ejection roller and the spur alone. Transportation control by the detector is thus no longer performed, which may possibly deteriorate transportation accuracy of a sheet of paper. Further, a detection roller, serving as the detector, is supported by radial bearings provided with circular holes, and is therefore not able to suppress torsional vibrations, which may possibly adversely affect transportation of a sheet of paper. Meanwhile, the latter medium transporting device is able to calculate a correction value only when a sheet of paper provided with the test pattern is transported, and this value is effective in a short region for merely a limited kind of sheet of paper.

SUMMARY OF THE INVENTION

It is therefore an object of the invention to provide a medium transporting device insusceptible to any error that may occur during transportation of a medium and thereby achieving high transportation accuracy, and a recording apparatus equipped with the medium transporting device.

In order to achieve the above object, according to the invention, there is provided an apparatus for transporting a medium, comprising:

- a transporting path, through which the medium is transported;
- a detection roller, which is directly brought into contact with the medium and is rotated in accordance with the transportation of the medium;
- a detector, which detects a rotation amount of the detection roller; and
- a controller, which controls the transportation of the medium in accordance with the rotation amount.

With this configuration, the transportation amount of the medium can be set as an object to be controlled. Accordingly, the transportation with high accuracy can be attained almost without being affected by any intervening tolerances.

Preferably, the apparatus further comprises: a first roller, which transports the medium toward the transporting path; and a second roller, which ejects the medium transported from the transporting path to the outside of the apparatus. The detection roller is disposed in the vicinity of at least one of the first roller and the second roller.

With this configuration, the transportation amount of the ejected medium can be set as an object to be controlled. Accordingly, the medium transportation executed only by the second roller can be accurately controlled.

Here, it is preferable that the apparatus further comprises an urging member which urges the detection roller against the first roller.

In this case, the movement of the medium can be directly detected all the time during the transportation. Accordingly, the transportation can be controlled with high accuracy.

It is further preferable that the urging member comprises at least one rotary member which is rotatable in accordance with the rotation of the detection roller.

In this case, even in a case where the detection roller has a small diameter, it is reliably pressed against the first roller while the rotation thereof is not interfered.

It is further preferable that the urging member comprises at least four rotary members disposed so as to come in contact with two portions on the detection roller in an axial direction thereof and with two portion on the detection roller in a circumferential direction thereof.

In this case, the vibration generated when the small-diameter detection roller is rotated can be suppressed.

Preferably, the apparatus further comprises a friction applier, which applies a frictional force onto an outer periphery of the detection roller.

In this case, torsional vibrations generated in the detection roller can be reduced. Accordingly, the transportation amount of the medium can be detected with high accuracy.

It is more preferable that the friction applier is configured so as to restrict a movement of the detection roller in a radial direction thereof.

In this case, since the detection roller is configured to be merely rotated, it is able to follow the transportation of the medium with high accuracy.

It is further preferable that the friction applier comprises a press member which is pressed against the detection roller.

In this case, the movement of the detection roller in the radial direction thereof can be suppressed with a member having simple construction.

It is further preferable that the press member is pressed against the detection roller in a point-contact manner.

In this case, the press member can be configured by a simple mechanism using the leverage action. Accordingly, costs can be reduced.

It is also preferable that the friction applier comprises a support member which supports the detection roller so as to restrict a movement thereof in a direction that the medium is transported.

In this case, the movement of the detection roller in the medium transporting direction thereof can be suppressed with a member having simple construction.

It is more preferable that the support member supports the detection roller at least two points.

In this case, the support member can be configured by a simple mechanism using the leverage action. Accordingly, costs can be reduced.

It is also preferable that the support member is formed with a groove having a V-shaped cross section for supporting the detection roller.

In this case, the movement of the detection roller in the medium transporting direction can be reliably suppressed by simply putting the detection roller into the groove.

It is also preferable that the friction applier comprises an urging member which urges the press member against the detection roller.

In this case, the management for the pressing load with respect to the detection roller can be made easier. Accordingly, the movement of the detection roller in the radial direction thereof can be reliably suppressed.

Preferably, the detection roller has a common outer periphery which is directly brought into contact with the medium while being rotatably supported by a support member.

In this case, the medium contact portion and the shaft supporting portion can be integrally formed. Accordingly, the direct control of the medium transportation can be executed without being affected by the eccentricity of the detection roller.

Preferably, the controller controls the transportation of the medium in a feedback manner.

In this case, the medium transportation with high accuracy can be attained, so that the recording accuracy can be enhanced.

Preferably, the detector comprises a rotary encoder scale. In this case, the detector can be simply configured.

It is more preferable that: the detection roller is provided with a first mark indicating a direction and an amount of a first eccentricity of the detection roller which have been measured in advance; and the rotary encoder scale is provided with a second mark indicating a direction and an amount of a second eccentricity of the rotary encoder scale which have been measured in advance.

In this case, the detention roller and the detector which are capable of canceling the efficiencies thereof can be selected within a short while. Since the rotation of the roller transporting the medium can be directly controlled, the medium transportation can be controlled with high accuracy.

It is further preferable that: the direction of the first eccentricity is indicated by a position of the first mark, and the amount of the first eccentricity is indicated by a color of the first mark; and the direction of the second eccentricity is indicated by a position of the second mark, and the amount of the second eccentricity is indicated by a color of the second mark.

In this case, the detention roller and the detector which are capable of canceling the efficiencies thereof can be visually confirmed. Accordingly, erroneous choices for those members can be eliminated.

It is also preferable that a diameter of the detection roller is sufficiently smaller than a diameter of the rotary encoder scale.

In this case, the high detective resolution can be maintained.

According to the invention, there is also provided a liquid ejection apparatus, comprising:

- a liquid ejection head, operable to eject a liquid droplet toward a medium at a liquid ejection point;
- a first roller, which transports the medium toward the liquid ejection point;
- a second roller, which ejects the medium transported from the liquid ejection point to the outside of the apparatus;
- at least one detection roller, which is directly brought into contact with the medium and is rotated in accordance with the transportation of the medium, the at least one detection roller being disposed in the vicinity of at least one of the first roller and the second roller;
- a detector, which detects a rotation amount of the detection roller; and
- a controller, which controls the transportation of the medium in accordance with the rotation amount.

According to the invention, there is also provided a recording apparatus, comprising:

- a recording head, operable to record information on a medium at a recording point;
- a first roller, which transports the medium toward the recording point;
- a second roller, which ejects the medium transported from the recording point to the outside of the apparatus;
- at least one detection roller, which is directly brought into contact with the medium and is rotated in accordance with the transportation of the medium, the at least one detection roller being disposed in the vicinity of at least one of the first roller and the second roller,
- a detector, which detects a rotation amount of the detection roller; and
- a controller, which controls the transportation of the medium in accordance with the rotation amount.

DETAILED DESCRIPTION OF THE INVENTION

Embodiments of the invention will now be described in detail with reference to the accompanying drawings.

Figure 1:
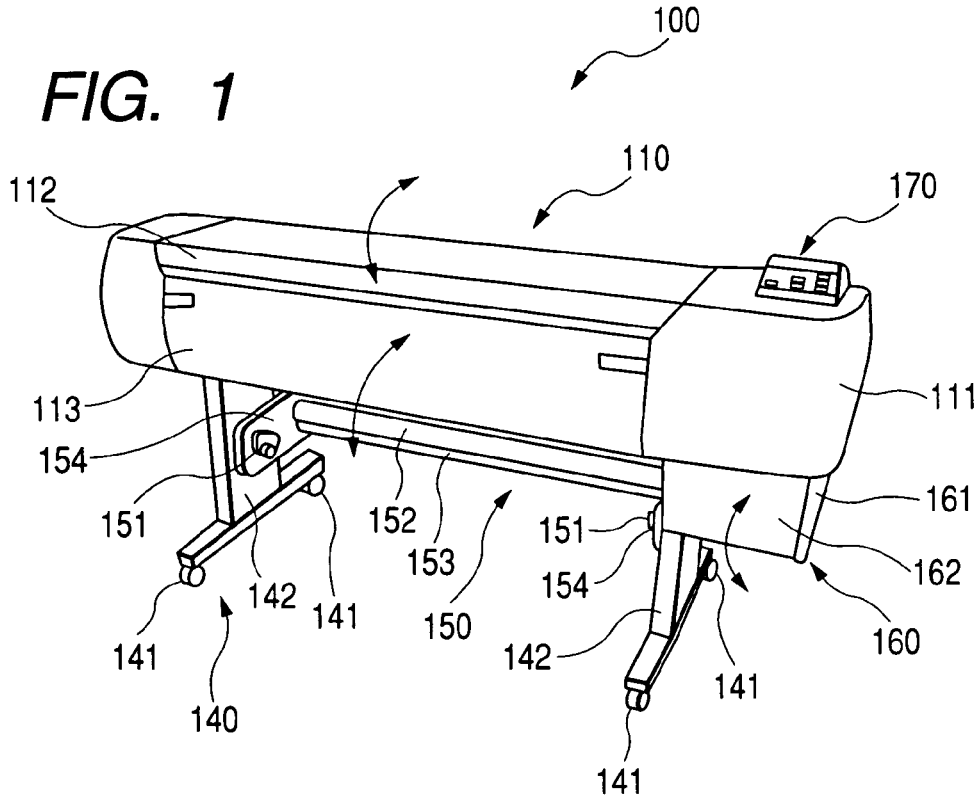
FIG. 1 is a perspective view showing a printer according to a first embodiment of the invention.
Figure 2:
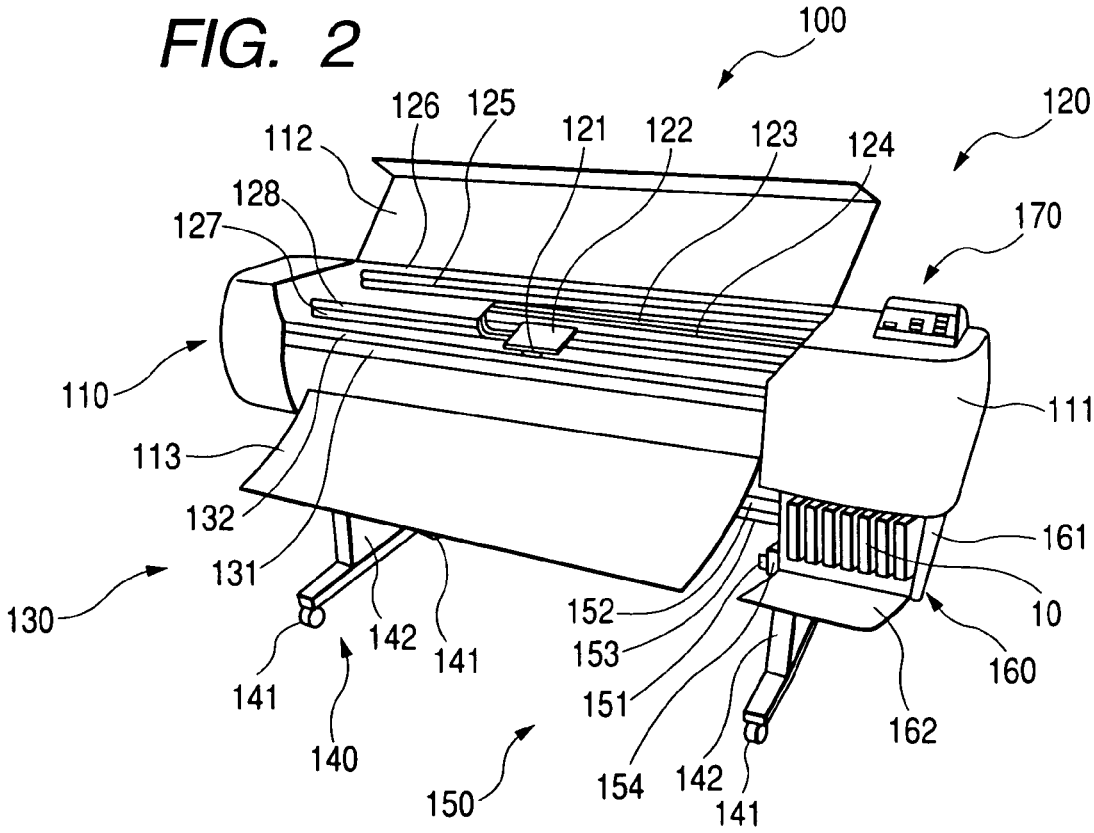
FIG. 2 is a perspective view showing the internal configuration of a essential portion of the printer of FIG. 1.
Figure 3:
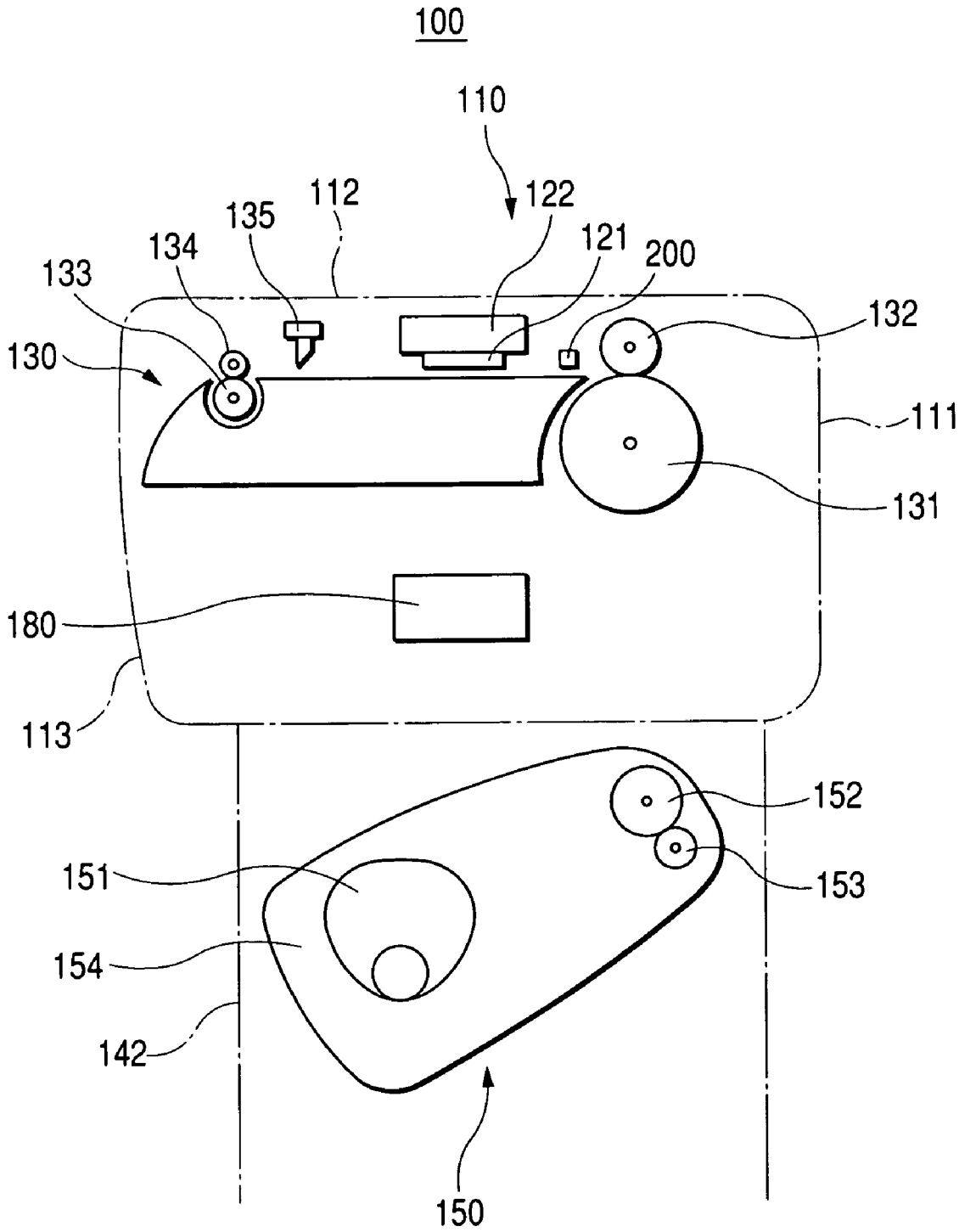
FIG. 3 is a cross section showing an essential portion of the printer of FIG. 1.

An ink jet printer 100 according to a first embodiment shown in FIG. 1 through FIG. 3 is a large-scaled printer that enables recording on rolled paper or a cut sheet having a paper width of a relatively large size, for example, the Japanese Industrial Standards (JIS) Size A1 paper or the JIS Size B1 paper. The ink jet printer 100 is configured in such a manner that a recording section 120 and a medium transporting device 130 are provided in the interior of a main body 110, and a paper feeder 150 is provided between legs 140 that support the main body 110.

As are shown in FIG. 1 through FIG. 3, the main body 110 includes a housing 111 made of plastic or a metal sheet to cover the recording section 120 and the medium transporting device 130. As are shown in FIG. 1 through FIG. 3, the housing 111 is provided with a top cover 112 and a front cover 113 made of translucent or transparent plastic or metal sheet for the top face and the front face to be released.

As are shown in FIG. 1 through FIG. 3, the top cover 112 is supported rotatably about the rear portion, and is thereby opened/closed when the user pushes up/pushes down the front portion by hand. The user is able to release widely a space above the recording section 120 and the medium transporting device 130 by opening the top cover 112. This makes it easier to perform maintenance on recording heads 121, a carriage 122 and the like, corrections of set position errors for rolled paper or a cut sheet, recovery from paper transportation errors, such as paper jamming during a recording or ejecting operation, etc.

As are shown in FIG. 1 through FIG. 3, the front cover 113 is supported pivotably about the bottom portion, and is thereby opened or closed when the user manually moves up or down the top portion thereof. The user is able to release widely a space below the recording section 120 and the medium transporting device 130 by opening the front cover 113. This makes it easier to perform recovery from paper transportation errors, such as paper jamming during a paper feed operation, etc.

Also, as are shown in FIG. 1 and FIG. 2, a holder main body 161 accommodating ink cartridges 10 of respective colors and an ink cartridge holder 160 having a cover 162 covering the front face of the holder main body 161 are provided at the lower-right portion when viewed from the front face of the main body 110. The cover 162 is supported in such a manner that it is rotatable about the bottom portion with respect to the hold main body 161, and is thereby opened or closed when the user manually moves up or down the top portion thereof. The user is able to release widely the holder main body 161 by opening the cover 162. This makes it easier to replace the ink cartridge(s) 10.

Further, as are shown in FIG. 1 and FIG. 2, a control panel 170 for the user to perform a manipulation, such as recording control, is provided at the upper-right portion when viewed from the front face of the main body 110. The control panel 170 is provided with a liquid crystal display screen and various kinds of buttons, so that the user is able to manipulate buttons or correct a set position error for rolled paper or a cut sheet while confirming the situations by watching the liquid crystal display screen. This enables the user to perform manipulations or jobs exactly through visual recognition, which can in turn eliminate operation errors or operation mistakes.

As are shown in FIG. 2 and FIG. 3, the recording section 120 comprises: the carriage 122 on which the recording heads 121 are mounted; flexible flat cables (hereinafter, abbreviated to FFCs) 123 to electrically connect the recording heads 121 to a recording executer in a controller 180; ink tubes 124 to connect the recording heads 121 and the respective ink cartridges 10 filled with ink, etc.

The recording heads 121 comprise a black ink recording head to eject black ink and a plurality of color ink recording heads to eject ink of respective colors, such as, dark yellow, yellow, light cyan, cyan, light magenta, and magenta. The recording heads 121 are provided with pressure generating chambers and nozzle openings communicating with the pressure generating chambers. By pressurizing ink stored in each pressure generating chamber at a predetermined pressure, an ink droplet of a controlled size is ejected through the nozzle opening toward rolled paper.

As is shown in FIG. 2, the carriage 122 is mounted on a rail 127 provided in the primary scanning direction via bearings and linked to a carriage belt 128. Hence, when the carriage belt 128 is moved by an unillustrated carriage driving device, the carriage 122 is guided by the rail 127 to reciprocate in association with motions of the carriage belt 128. The FFCs 123 are connected to a connector of the controller 180 at one end and to connectors of the recording heads 121 at the other end for a recording signal to be sent from the controller 180 to the recording heads 121.

The ink tubes 124 are provided for respective colors, and communicate respectively with the ink cartridges 10 of corresponding colors at one ends via unillustrated ink pressurizing and supplying members, and with the recording heads 121 of corresponding colors at the other ends. The ink tubes 124 supply ink of respective colors, pressurized by the ink pressurizing and supplying members, from the ink cartridges 10 to the recording heads 121.

As are shown in FIG. 2 and FIG. 3, the medium transporting device 130 comprises: a paper feeding roller 131 and a follower roller 132 that together transport rolled paper or a cut sheet in the secondary scanning direction; a ejection roller 133 and a follower roller 134 that together transport rolled paper or a cut sheet in the secondary scanning direction to be ejected; a cutter 135 to cut recorded rolled paper; an unillustrated paper suction member to prevent rolled paper or a cut sheet from being afloat; a transporting amount detector 200 shown in FIG. 3 to detect a quantity of transportation of rolled paper or a cut sheet, etca As the follower roller 134, for example, a spur (ratchet roller), or a disc whose rim has an acutely-angled cross section, can be used.

The paper feeding roller 131 is driven to rotate forward/backward by a driving force transmitted from an unillustrated motor. The follower roller 132 is pressed against the paper feeding roller 131 by an urging member, such as a spring, and thereby rotates forward/backward in association with the forward/backward rotational driving of the paper feeding roller 131. The paper feeding roller 131 and the follower roller 132 together pinch and deliver rolled paper or a cut sheet to be fed.

The ejection roller 133 is driven to rotate forward/backward by a driving force transmitted from the motor via the paper feeding roller 131. The follower roller 134 is pressed against the ejection roller 133 by an urging member, such as a spring, and thereby rotates forward/backward in association with the forward/backward rotational driving of the ejection roller 133. The ejection roller 133 and the follower roller 134 together pinch and send rolled paper or a cut sheet to be transported. As is shown in FIG. 3, the cutter 135 is provided to be free to move in a vertical direction and in the primary scanning direction with the cutting edge pointing downward.

The transporting amount detector 200 is provided in a space between the paper feeding roller 131 and the recording head 121 to be connected to the controller 180, and performs feedback control as to transportation of rolled paper or a cut sheet by detecting a quantity of transportation of rolled paper or a cut sheet and by outputting a signal, indicating a transportation position and a transportation velocity, to the controller 180.

Figure 4B:
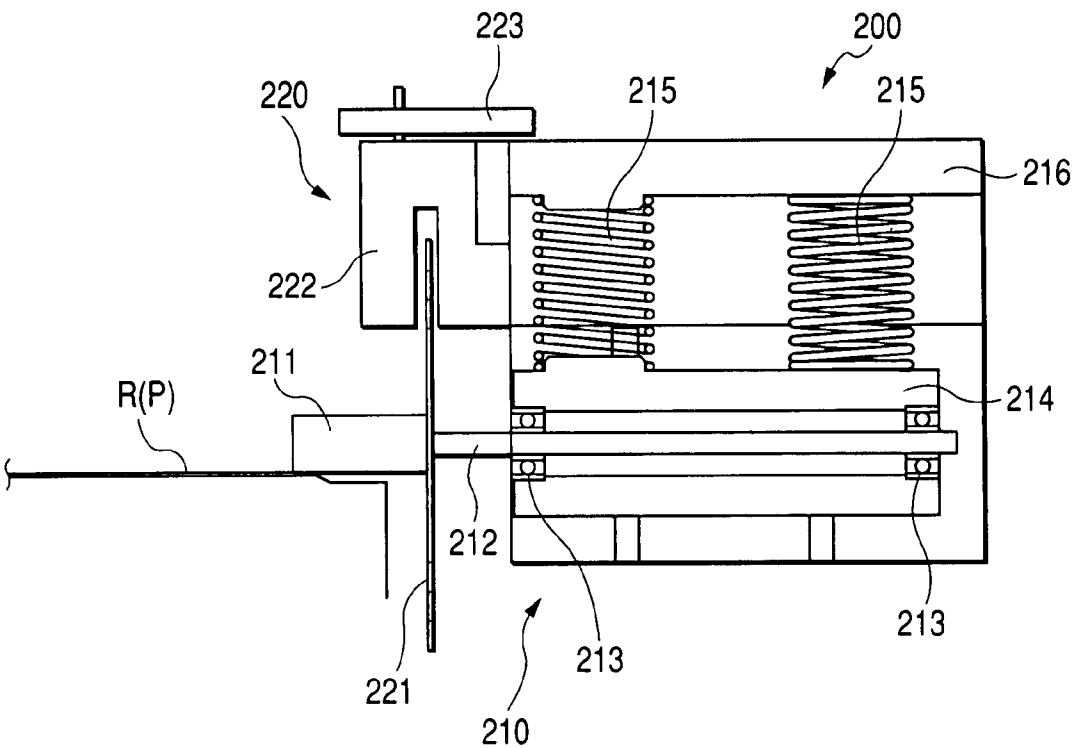
FIG. 4B is a side view showing the transporting amount detector of FIG. 4A.
Figure 4A:
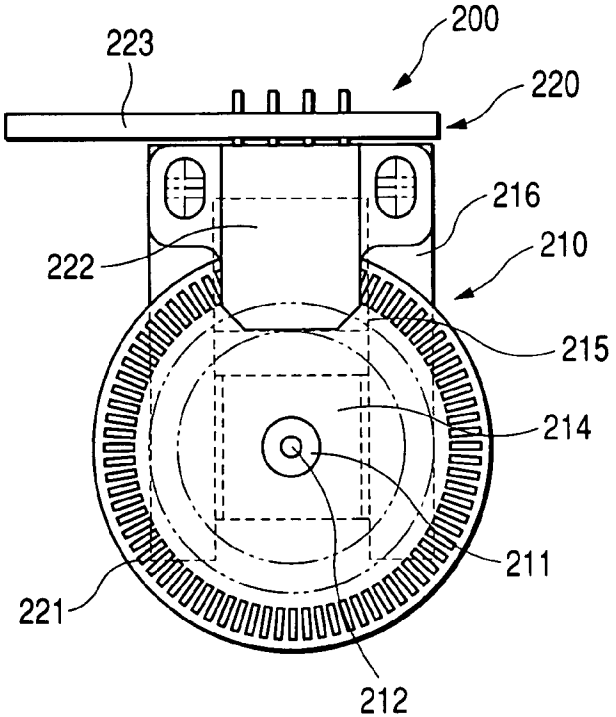
FIG. 4A is a plan view showing a transporting amount detector in the printer of FIG. 1.

As are shown in FIG. 4A and FIG. 4B, the transporting amount detector 200 comprises a detection roller 210 that rolls in association with transportation of rolled paper R or a cut sheet P, and a detector 220 to detect a quantity of rotations of the detection roller 210. The detection roller 210 comprises: a roller body 211 that rotates by coming in direct contact with rolled paper R and a cut sheet P; a pair of bearings 213 to axially support a shaft 212 of the roller body 211 at the both ends thereof; a holder 214 to hold these bearings 213; a pair of compression springs 215 to support the holder 214; a case 216 to support these compression springs 215 as well as the holder 214 to be free to move in a vertical direction, etc.

The detector 220 comprises: a rotary encoder scale 221 made of a disc-shaped plastic plate and attached to the roller body 211; an optical sensor 222 comprising a light receiving and emitting element provided to sandwich slit portions in the rotary encoder scale 221 and attached to the case 216; a circuit board 223 connected to the optical sensor 222, etc.

According to the transporting amount detector 200 configured as above, the rotary encoder scale 221 rotates together with the roller body 211 that is axially supported by the bearings 213 in association with transportation of rolled paper R or a cut sheet P. The circuit board 223 is thus able to detect, at high accuracy, a quantity of rotations of the roller body 211, that is, a quantity of transportation of rolled paper R or a cut sheet P, via the optical sensor 222. Further, because the diameter of the roller body 211 can be made extremely small, control at high detection resolution is enabled. Should rolled paper R or a cut sheet P fluctuate while being transported, the holder 214 supporting the roller body 211 undergoes displacement inside the case 216 due to the action of the compression springs 215. This eliminates adverse affects to rotations of the roller body 211 associated with transportation of roller paper R or a cut sheet P.

As is shown in FIG. 3, the transporting amount detector 200 is provided in a space between the paper feeding roller 131 and the recording head 121; however, it may be provided directly above the paper feeding roller 131, at the upper stream portion of the paper feeding roller 131 in the transportation direction, or at the lower stream portion of the recording heads 121 in the transportation direction. The detector 220 may comprise, instead of the rotary encoder scale 221, the optical sensor 222, and the circuit board 223, respectively, a magnetic encoder attached to the roller body 211, a magnetic sensor, attached to the case 216, to detect a change in magnetism of the magnetic encoder, and a circuit board connected to the magnetic sensor.

Figure 5:
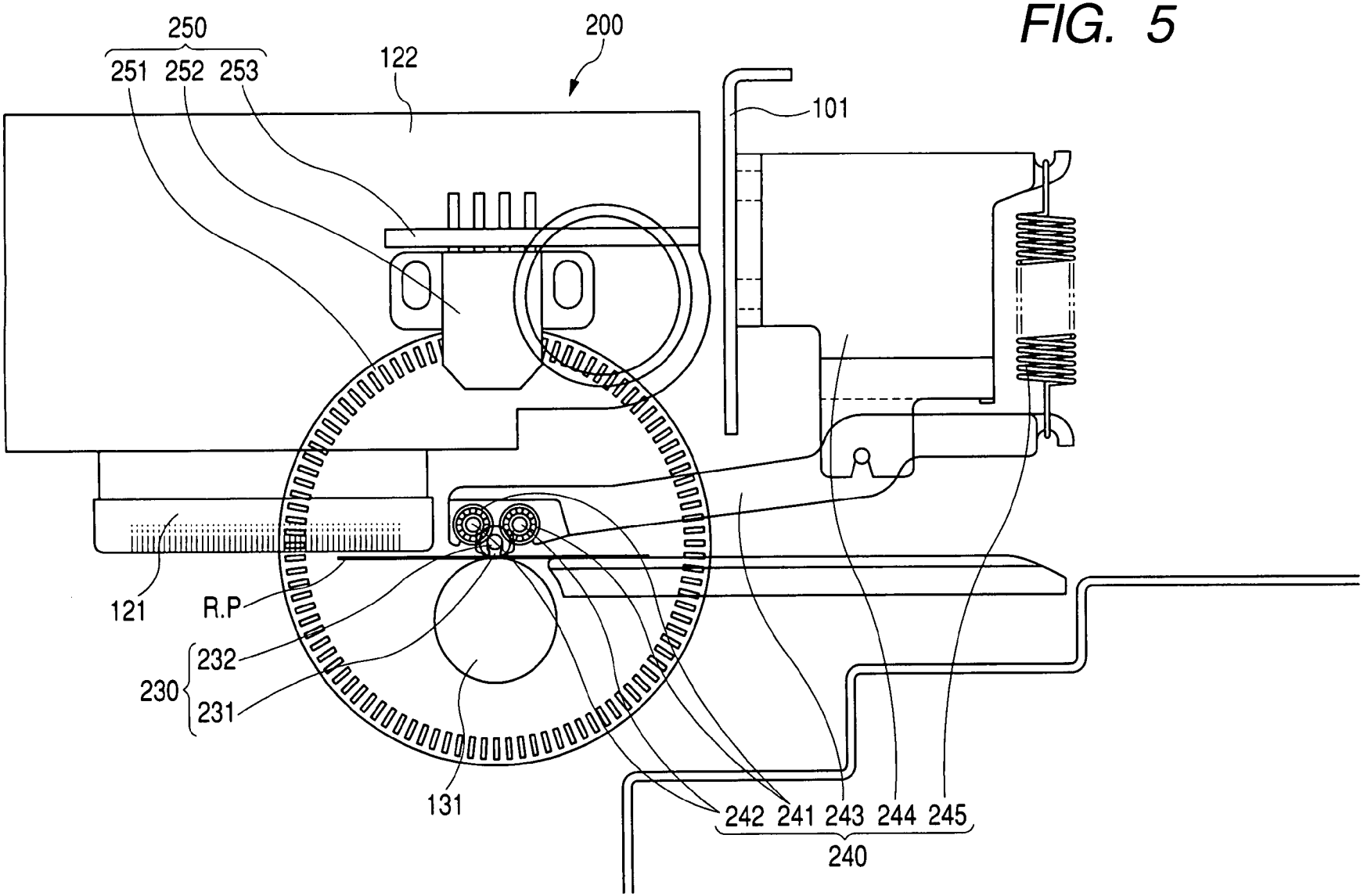
FIG. 5 is a plan view showing a transporting amount detector according to a second embodiment of the invention.
Figure 6:
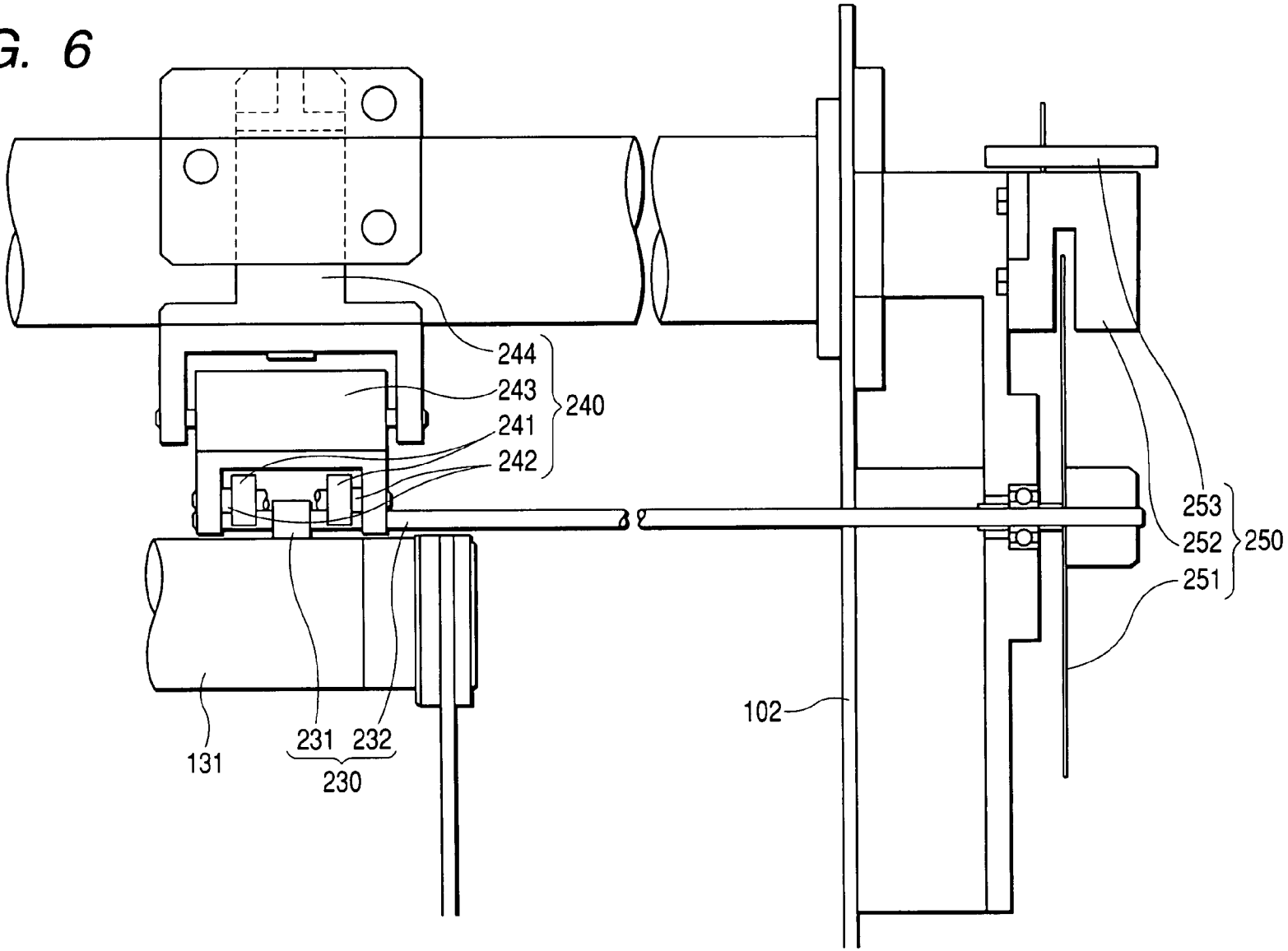
FIG. 6 is a side view showing the transporting amount detector of FIG. 5.

FIG. 5 and FIG. 6 show a second embodiment of the invention. Like components are labeled with like reference numerals and the description thereof will be omitted. A transporting amount detector 200 in this embodiment comprises: a detection roller 230 that rolls in association with transportation of rolled paper R or a cut sheet P; a pressing member 240 to press the detection roller 230 against the paper feeding roller 131; and a detector 250 to detect a quantity of rotations of the detection roller 230. The detection roller 230 is provided directly above the paper feeding roller 131, and comprises a roller body 231 that rotates by coming into direct contact with rolled paper R or a cut sheet P, a shaft 232 penetrating through the roller body 231, etc. The roller body 231, made of metal, such as stainless, is coated with nonslip ceramic powder on the periphery, and is shrink-fit at one end of the shaft 232 also made of metal, such as stainless. When temperature corrections or the like are possible, the roller body 231 may be made of rubber or the like.

The pressing member 240 comprises: rotors 241 that keep the shaft 232 pushed down from above in close proximity to the both ends of the roller body 231; a supporting arm 243 to axially support the shaft 232 of the roller body 231 and the shaft 242 of the rotors 241; a supporter 244 to support the supporting arm 243 to be free to pivot; a tensile spring 245 to keep pushing the supporting arm 243, etc. Four rotors 241 are provided in close proximity to the both ends of the roller body 231 on the both sides in the axial direction and in the radial direction of the shaft 232.

To serve as the rotors 241, it is sufficient to assist the roller body 231 to be pressed against the paper feeding roller 131, and for example; bearings, metal or plastic rollers, etc. can be used. At one end, the supporting arm 243 axially supports the shaft 232 of the roller body 231 to be free to rotate while supporting the axes 242 of the rotors 241 fixedly. The supporter 244 is fixed to the main body frame 101, and axially supports the supporting arm 243 nearly at the center to be free to pivot. The tensile spring 245 is stopped by the supporter 244 at one end and, and is stopped at the other end by the other end of the supporting arm 243.

The detector 250 comprises: a rotary encoder scale 251 made of a disc-shaped plastic plate and attached to the other end of the shaft 232 of the roller body 231; an optical sensor 252 comprising a light receiving and emitting element provided to sandwich slit portions in the rotary encoder scale 251 and attached to the main body frame 102; a circuit board 253 connected to the optical sensor 252, etc. The detector 250 may comprise, instead of the rotary encoder scale 251, the optical sensor 252, and the circuit board 253, respectively, a magnetic encoder attached to the roller body 231, a magnetic sensor, attached to the main body frame 102, to detect a change in magnetism of the magnetic encoder, and a circuit board connected to the magnetic sensor.

According to the transporting amount detector 200 in this embodiment, because the rotors 241 keep pressing the roller body 231 against the paper feeding roller 131, it is possible to suppress turbulence while the roller body 231 is rolling in association with transportation of rolled paper R or a cut sheet P. Hence, not only can the diameter of the roller body 231 be reduced further to an extremely small size, but also the length of the shaft 232 of the roller body 231 can be increased further. It is thus possible to provide the roller body 231 directly above the paper feeding roller 131 to be astride an ejectionability recovering device of the recording heads 121.

For instance, let r be the diameter of the roller body 231, R be the diameter of the rotary encoder scale 251, and 1/n be a slit interval, then detection resolution as high as (1/n)·(r/R) can, be achieved on the roller body 231, which can in turn improve the stopping accuracy or enables more elaborate corrections to be made, etc. Hence, motions of rolled paper R or a cut sheet P can be detected more directly while keeping detection resolution high, and transportation can be thus controlled at a further higher degree of accuracy. The transporting amount detector 200 in this embodiment may be provided as well at the upper stream portion of the paper feeding roller 131 in the transportation direction or at the lower stream portion of the recording heads 121 in the transportation direction.

Figure 7:
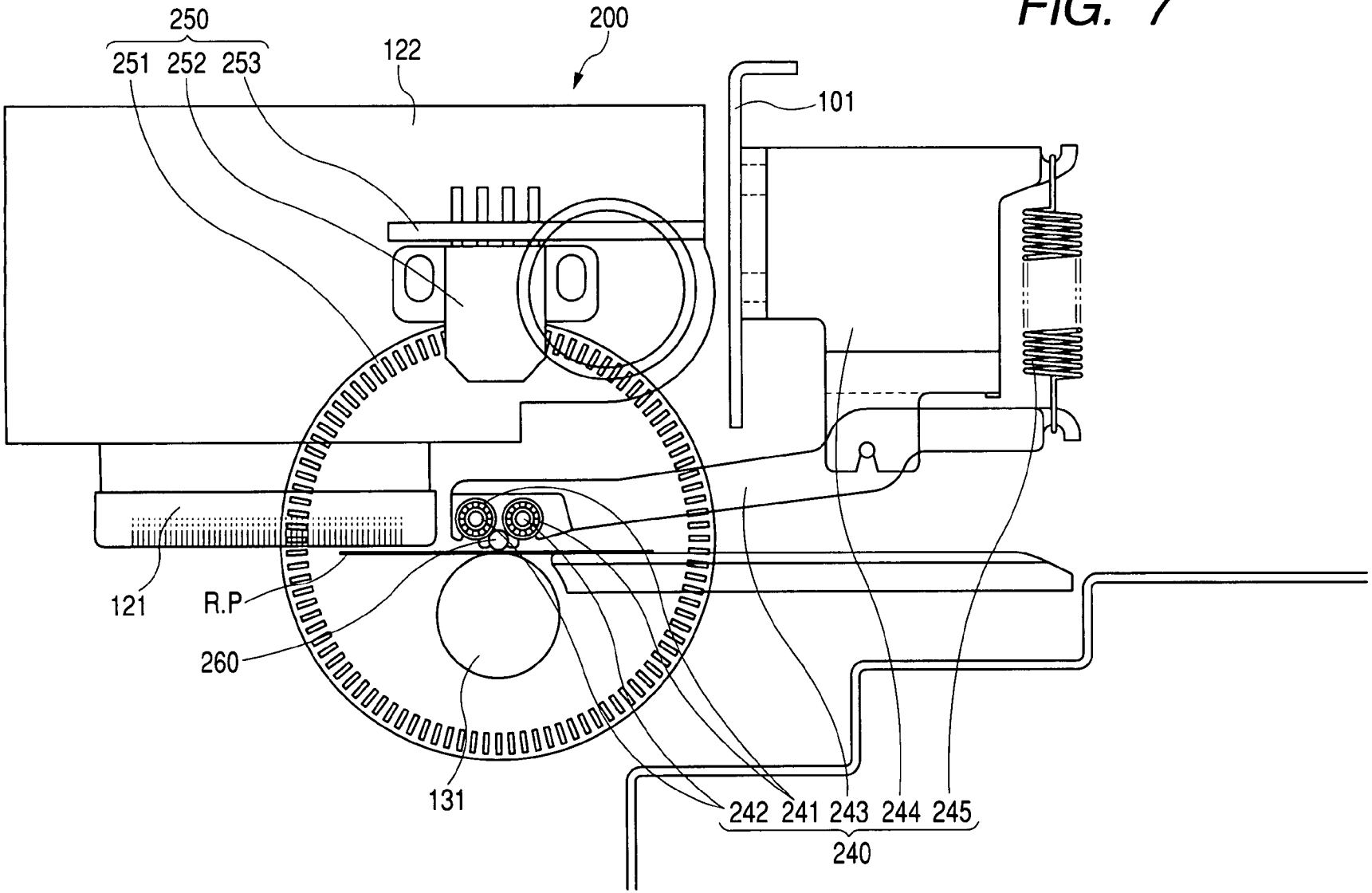
FIG. 7 is a plan view showing a transporting amount detector according to a third embodiment of the invention.
Figure 8:
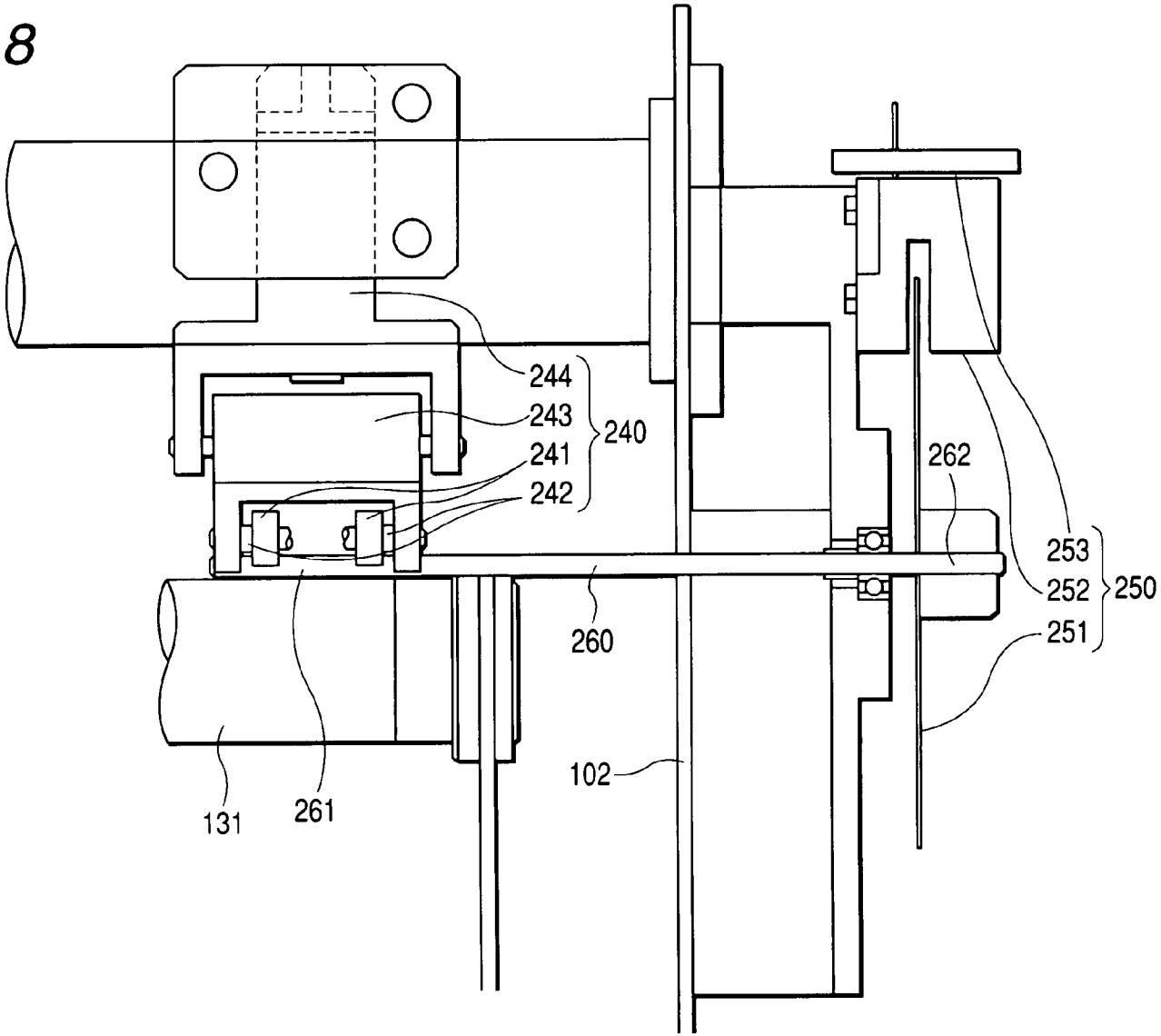
FIG. 8 is a side view showing the transporting amount detector of FIG. 7.

FIG. 7 and FIG. 8 show a third embodiment of the invention. Like components are labeled with like reference numerals and the description thereof will be omitted. In a transporting amount detector 200 in this embodiment, a pressing member 240 and a detector 250 are of the same configuration as the counterparts in the second embodiment; however, a detection roller 260 that rolls in association with transportation of rolled paper R or a cut sheet P is of a different configuration.

To be more specific, unlike the detection roller 230 of the second embodiment that is divided into the roller body 231 and the shaft 232 having different diameters, the detection roller 260 is formed into a shape of a round rod having the same diameter. The detection roller 260 functions at one end, that is, a section on the side kept pushed down by the rotors 241, as a rotary section 261 that rotates in association with transportation of a sheet of paper, and functions at the other end, that is, a section on the side where the rotary encoder scale 251 is fit in, as an axial supporter 262 that axially supports the rotary section 261. The detection roller 260 is made of metal, such as stainless, and may be coated with non-slip ceramic powder on the periphery of the rotary section 261.

Because the rotary section 261 and the axial supporter 262 are both formed on the same outer peripheral face of the detection roller 260 as has been described, it is possible to manufacture a detection roller 260 in which there is no substantial eccentricity between the rotary section 261 and the axial supporter 262 by processing materials of the detection roller 260 integrally through polishing or the like. In addition, most of influences of the eccentricity in the fitting portion of the axial supporter 262 of the detection roller 260 and the rotary encoder scale 251 can be cancelled, by giving a larger ratio for the diameter of the rotary encoder scale 251 with respect to the diameter of the axis supporter 262. For example, let r be the diameter of the detection roller 260, R be the diameter of the rotary encoder scale 251, and 1/n be a slit interval, then detection resolution as high as (1/n)·(r/R) can be achieved on the detection roller 260, which can in turn improve the stopping accuracy and enables more elaborate corrections to be made. Precise, direct control on transportation of a sheet of paper that is substantially insusceptible to the influences of the eccentricity is thus enabled.

Figure 9:
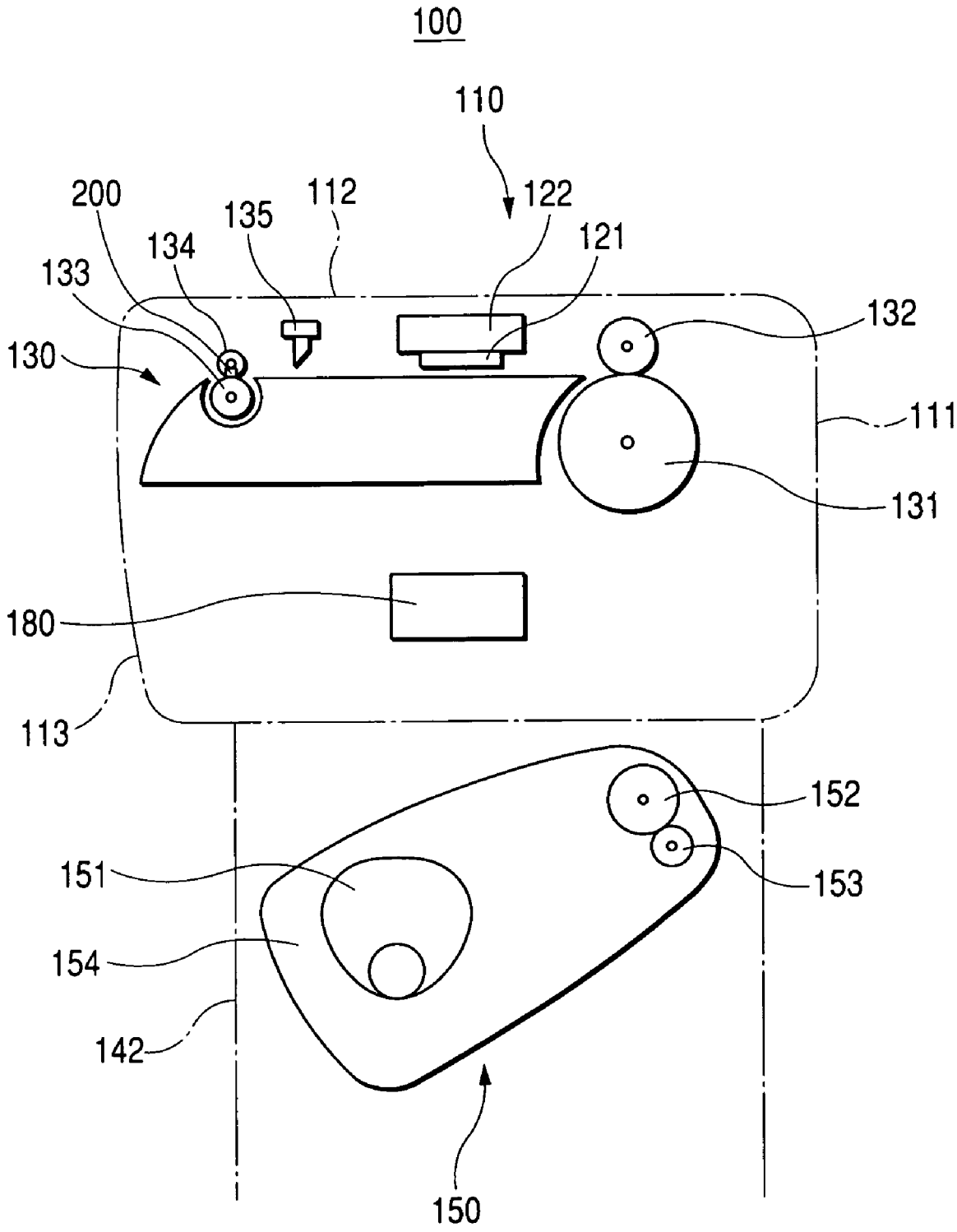
FIG. 9 is a cross section showing an essential portion of a printer according to a fourth embodiment of the invention.
Figure 10B:
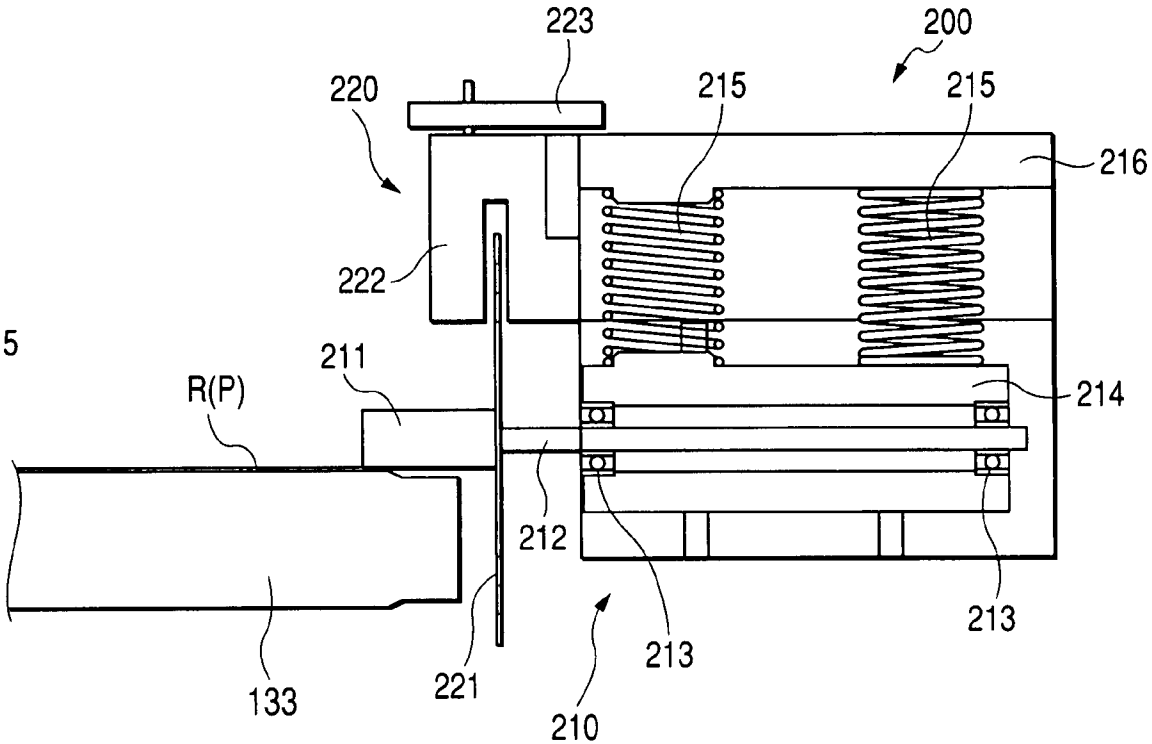
FIG. 10B is a side view showing the transporting amount detector of FIG. 10A.
Figure 10A:
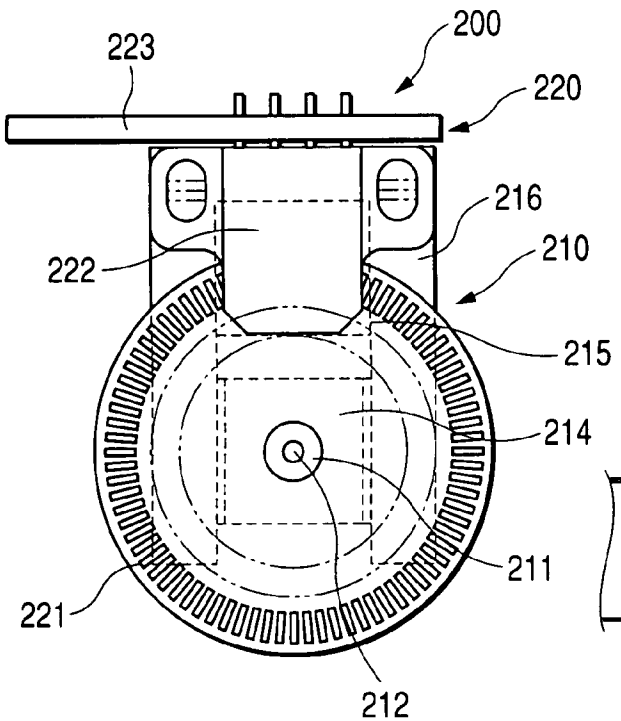
FIG. 10A is a plan view showing a transporting amount detector in the printer shown in FIG. 9.

FIG. 9 through FIG. 10B show a fourth embodiment of the invention. Like components are labeled with like reference numerals and the description thereof will be omitted. In this embodiment, the transporting amount detector 200 in the first embodiment shown in FIG. 4A and FIG. 4B is provided to the ejection roller 133. Alternatively, the transporting amount detector 200 may be provided to both the paper feeding roller 131 and the ejection roller 133.

Figure 11:
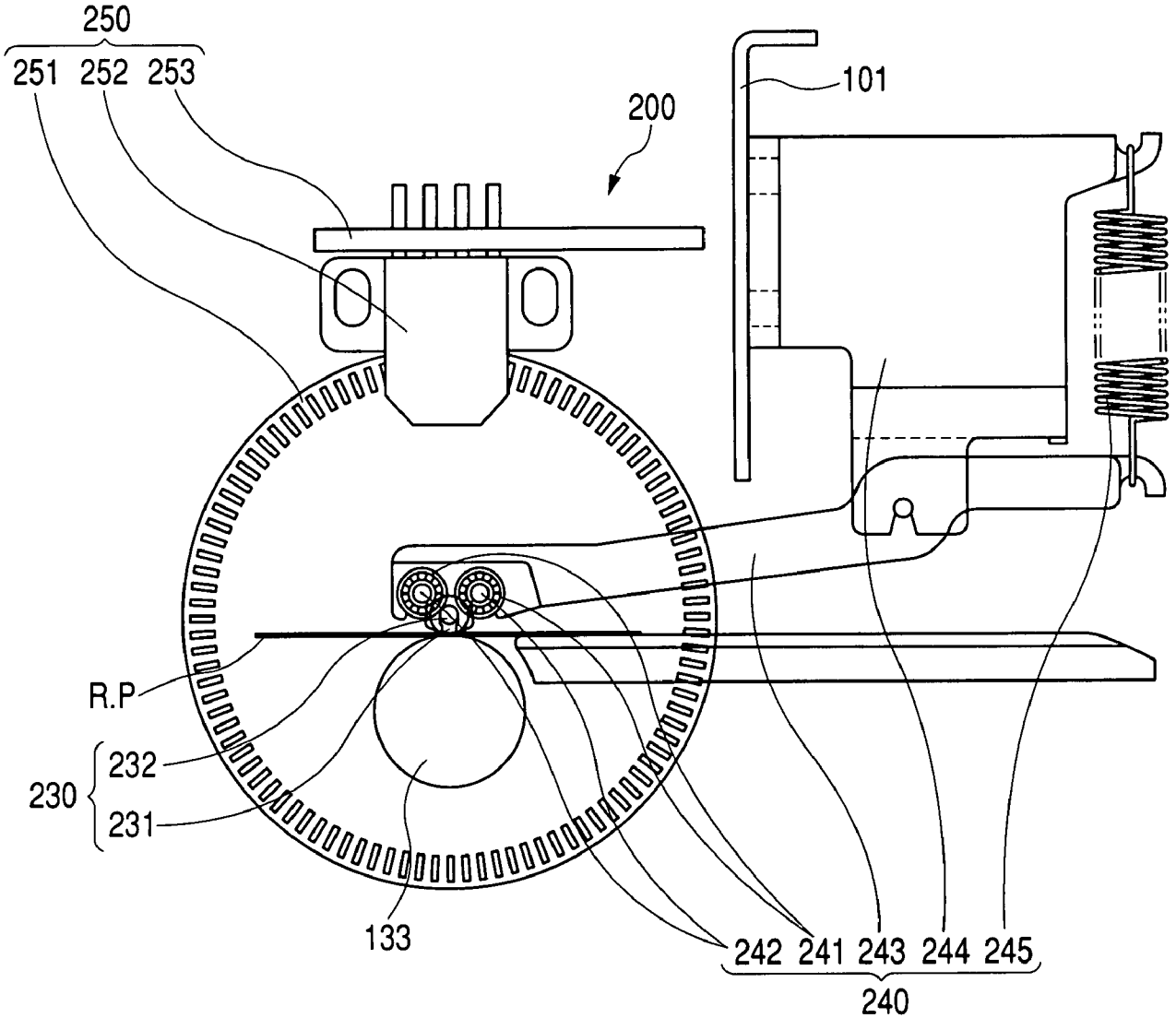
FIG. 11 is a plan view showing a transporting amount detector according to a fifth embodiment of the invention.
Figure 12:
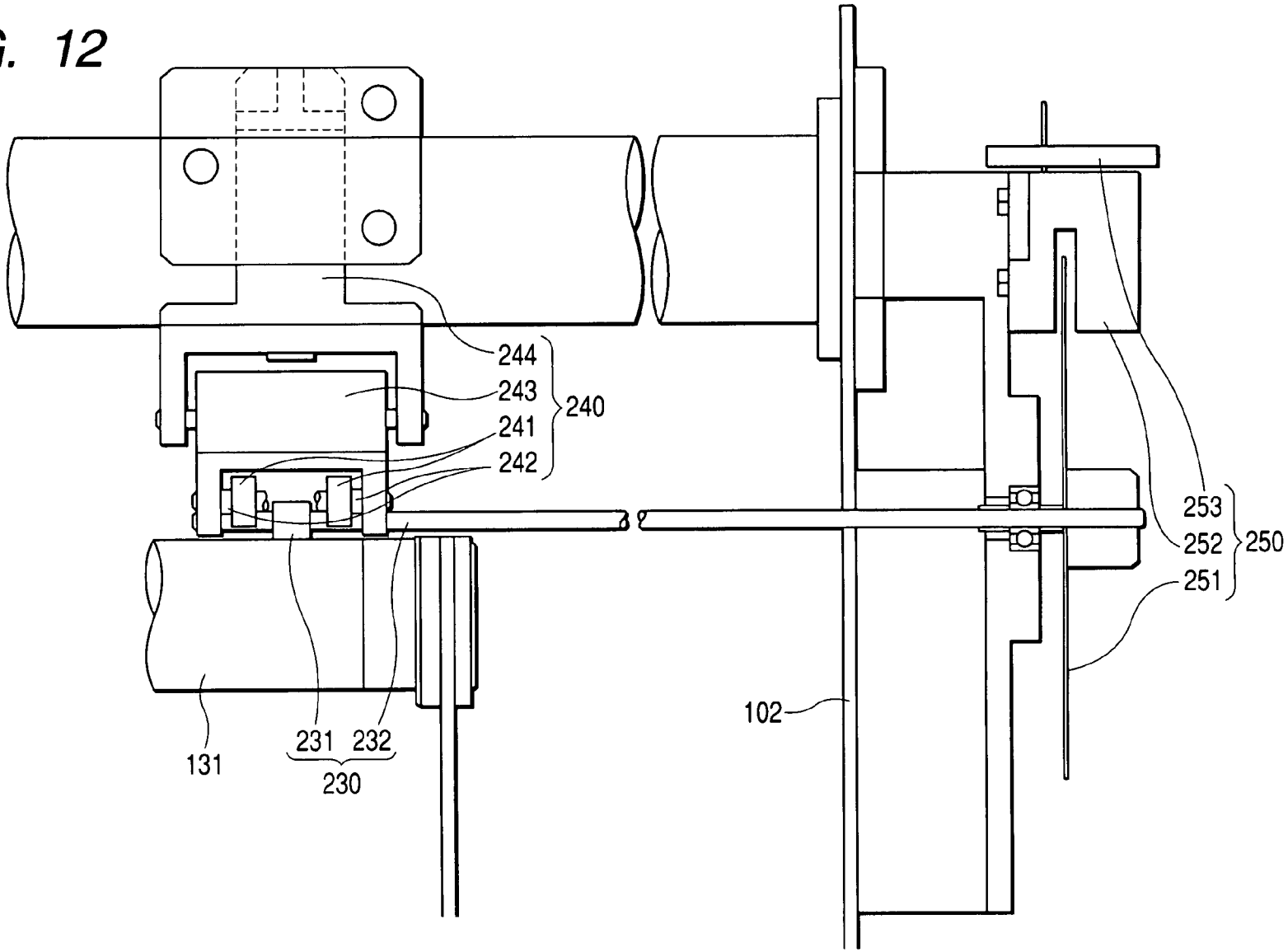
FIG. 12 a side view showing the transporting amount detector of FIG. 11.

FIG. 11 and FIG. 12 show a fifth embodiment of the invention. Like components are labeled with like reference numerals and the description thereof will be omitted. In this embodiment, the transporting amount detector 200 in the second embodiment shown in FIG. 5 and FIG. 6 is provided to the ejection roller 133. Alternatively, the transporting amount detector 200 may be provided to both the paper feeding roller 131 and the ejection roller 133.

Figure 13:
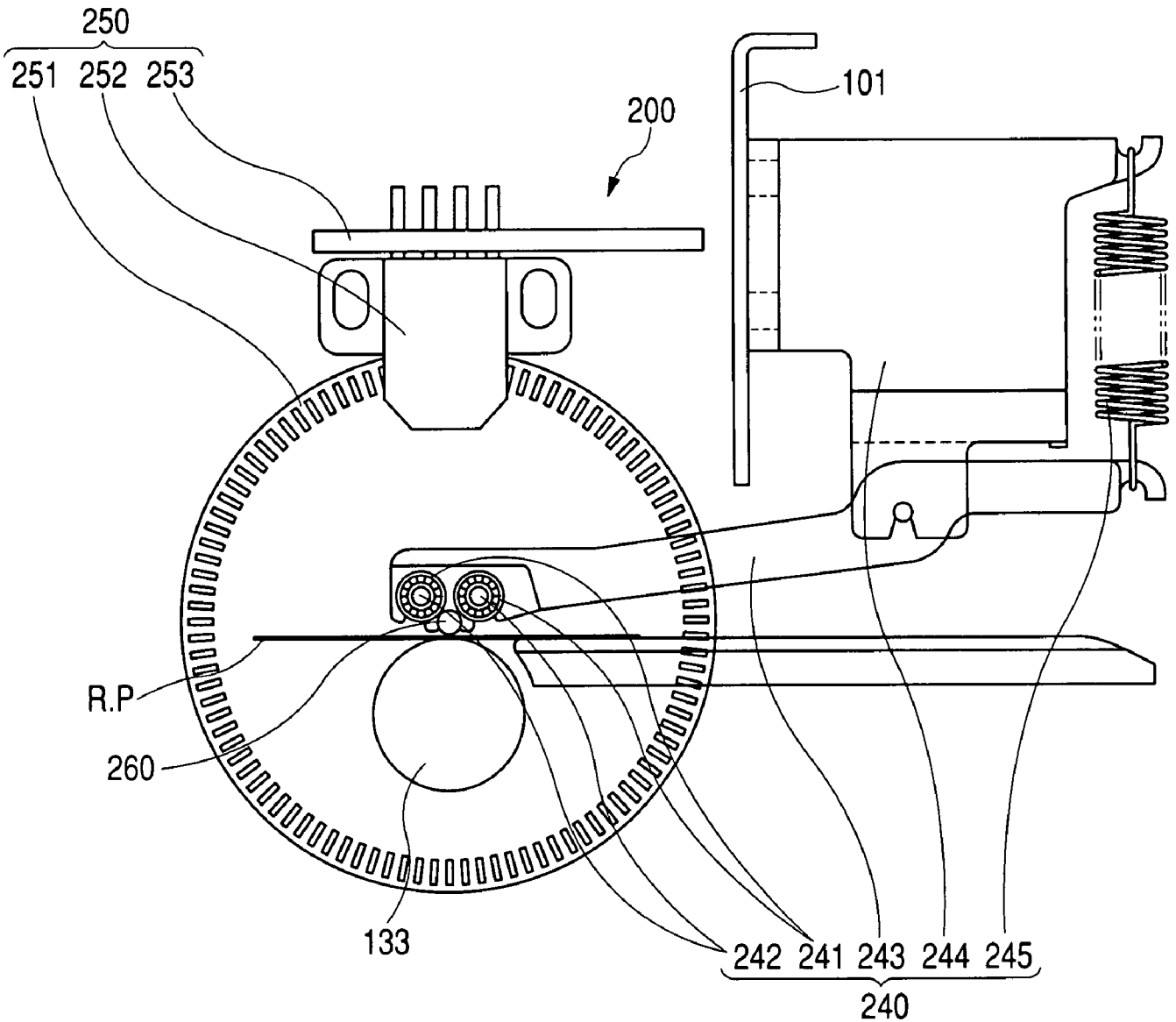
FIG. 13 is a plan view showing a transporting amount detector according to a sixth embodiment of the invention.
Figure 14:
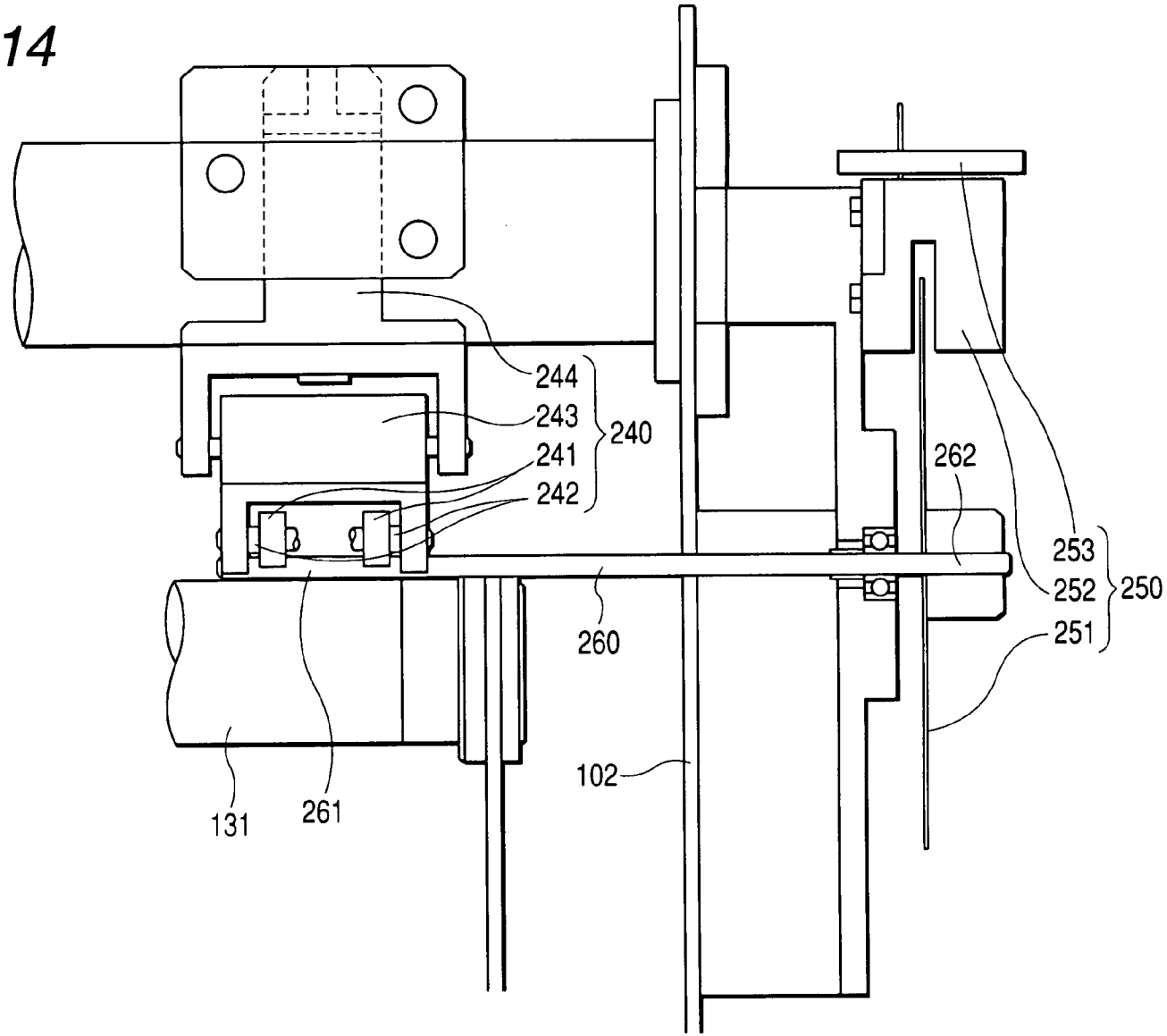
FIG. 14 a side view showing the transporting amount detector of FIG. 13.

FIG. 13 and FIG. 14 show a sixth embodiment of the invention. Like components are labeled with like reference numerals and the description thereof will be omitted. In this embodiment, the transporting amount detector 200 in the third embodiment shown in FIG. 7 and FIG. 8 is provided to the ejection roller 133. Alternatively, the transporting amount detector 200 may be provided to both the paper feeding roller 131 and the ejection roller 133.

According to the configurations of the fourth through sixth embodiments, once the trailing end of a sheet of paper is released from pinching between the paper feeding roller 131 and the follower roller 132, the sheet of paper is transported by being pinched between the ejection roller 133 and the follower roller 134 alone; however, because the transporting amount detector 200 performs transportation control, the sheet of paper can be transported at high accuracy.

FIG. 15 through FIG. 17B show a seventh embodiment of the invention. Like components are labeled with like reference numerals and the description thereof will be omitted. A transporting amount detector 200 in this embodiment comprises: a detection roller 270 that rotates in accordance with transportation of rolled paper R or a cut sheet P; a friction applier 280 to apply a frictional resistance on the peripheral face of the detection roller 270; and a detector 290 to detect a quantity of rotations of the detection roller 270.

Figure 16:
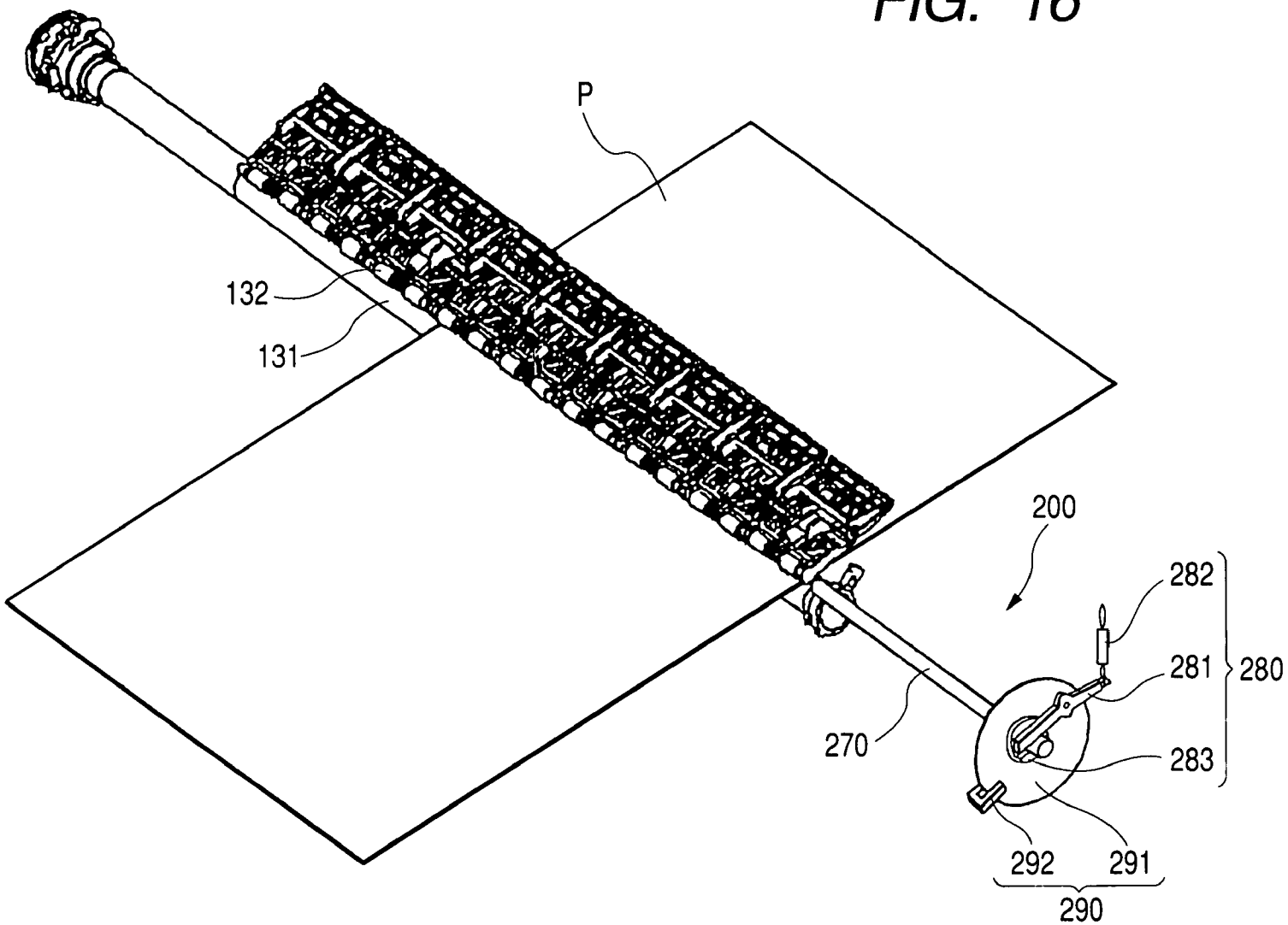
FIG. 16 is a perspective view showing a transporting amount detector in the printer of FIG. 15.

As is shown in FIG. 16, the detection roller 270 is provided in such a manner that one end comes in direct contact with one end of the paper feeding roller 131 directly above, and the friction applier 280 and the detector 290 are provided at the other end. The detection roller 270 is made of metal, such as stainless, and is shaped like a single round rod. Rotors that keep the detection roller 270 pushed down from above at one end may be provided. By providing four rotors on the both sides in the axial direction and in the radius direction of the detection roller 270, it is possible to rotate the detection roller 270 in a more stable manner.

Figure 17A:
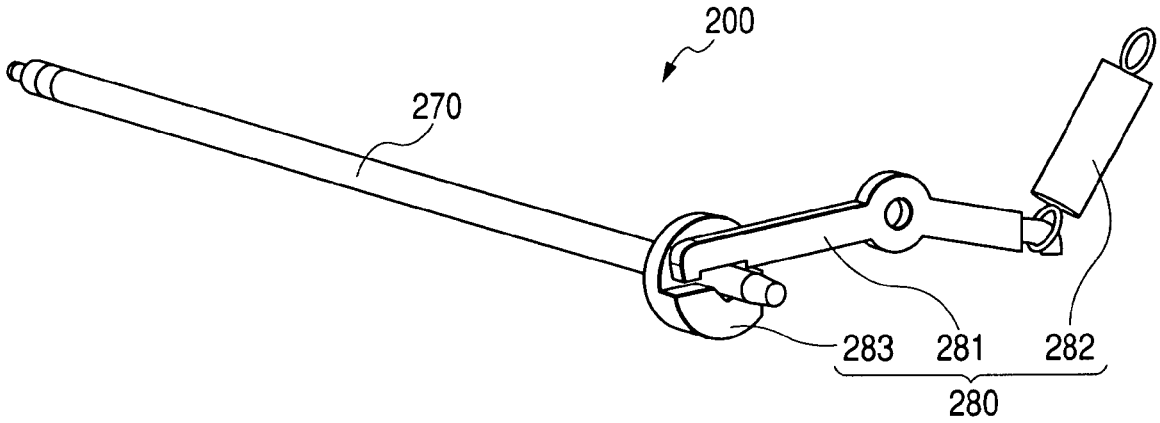
FIG. 17A is a perspective view showing an essential portion of the transporting amount detector of FIG. 16.
Figure 17B:
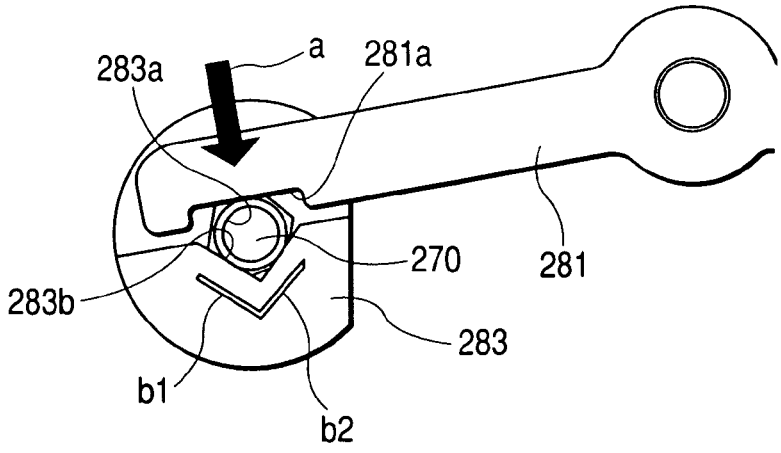
FIG. 17B is a side view showing an essential portion of the transporting amount detector of FIG. 16.

As are shown in FIG. 16 and FIG. 17A, the friction applier 280 comprises a shaft pressing lever 281 and a tensile spring 282 to keep the detection roller 270 pushed down from above, a bearing 283 to axially support the detection roller 270, etc. The shaft pressing lever 281 is axially supported at the center by an unillustrated printer main body or the like to be free to pivot. A flat groove 281*a* is formed on the lower face at one end to abut on the upper outer peripheral face of the detection roller 270 at one point, and one end of the tensile spring 282 is stopped at the other end. The other end of the tensile spring 282 is stopped by the unillustrated printer main body or the like. In the bearing 283 is made a through hole 283*a* for the detection roller 270 to penetrate through. A V-shaped groove 283*a* is formed on the lower inner peripheral face of the through hole 283*a* to abut on the lower outer peripheral face of the detection roller 270 at two points.

By providing the friction applier 280 configured as described above, as is shown in FIG. 17B, the friction applier 280 confers frictional resistance on the detection roller 270 while supporting the outer peripheral face of the detection roller 270 at three points. It is thus possible to regulate runouts in the radial direction by reducing torsional vibrations occurring in the detection roller 270. To be more specific, because the shaft pressing lever 281 keeps the detection roller 270 pushed down from above in a direction indicated by an arrow "a" in the drawing due to the function of the tensile spring 282, of the runouts of the detection roller 270 in the radial direction, runouts in the vertical direction can be regulated. Also, because the bearing 283 supports the detection roller 270 from diagonally below on the both sides, which are indicated by b1 and b2 in the drawing, due to the function of the shaft pressing lever 281 and the tensile spring 282, of the runouts of the detection roller 270 in the radial direction, the runouts in the paper transportation direction can be regulated.

As is shown in FIG. 16, the detector 290 comprises a rotary encoder scale 291 made of a disc-shaped plastic plate and attached to the other end of the detection roller 270, an optical sensor 292 comprising a light receiving and emitting element provided to sandwich the slit portions in the rotary encoder scale 291 and attached to the unillustrated printer main body, etc. The detector 290 may comprise, instead of the rotary encoder scale 291 and the optical sensor 292, respectively, a magnetic encoder attached to the detection roller 270 and a magnetic sensor, attached to the unillustrated printer main body, to detect a change in magnetism of the magnetic encoder.

For the transporting amount detector configured as has been described, it is necessary to manage a load to be applied to the detection roller in reducing the torsional vibrations occurring in the detection roller. The transporting amount detector conventionally applies a load to the detection roller by pushing the radial bearing that supports the detection roller, in an axial direction with the use of a spring. Hence, a spring having a high spring constant is needed, which makes it difficult to manage a load. In this embodiment, however, friction resistance is applied on the detection roller 270 by supporting the outer peripheral face of the detection roller 270 at three points by the friction applier 280 through the use of this principle, which makes it easy to manage a load.

In addition, the transporting amount detector in the related art is fixed to the printer main body. This allows the follower roller 132 to be released from the paper feeding roller 131 with ease, but inhibits the detection roller from being released from the paper feeding roller 131. It is therefore difficult to insert a sheet of paper in a space between the paper feeding roller 131 and the follower roller 132. In contrast, the transporting amount detector 200 in this embodiment is not fixed to the printer main body, and the detection roller 270 can be released from the paper feeding roller 131 with ease. It is therefore easy to insert a sheet of paper in a space between the paper feeding roller 131 and the follower roller 132.

Also, let r be the diameter of the detection roller 270, R be the diameter of the rotary encoder scale 291, and 1/n be a slit interval, then, because the torsional vibrations occurring in the detection roller 270 are reduced, it is possible to obtain detection resolution as high as $(1/n)\cdot(r/R)$ on the detection roller 270 by making the diameter of the detection roller 270, r, sufficiently small with respect to the diameter of the rotary encoder scale 291, R. Hence, not only can stopping accuracy be improved, but also more elaborate corrections can be made. It is thus possible to detect motions of rolled paper R or a cut sheet P more directly while keeping the detection resolution high, which in turn enables transportation to be controlled at a further higher degree of accuracy.

Figure 15:
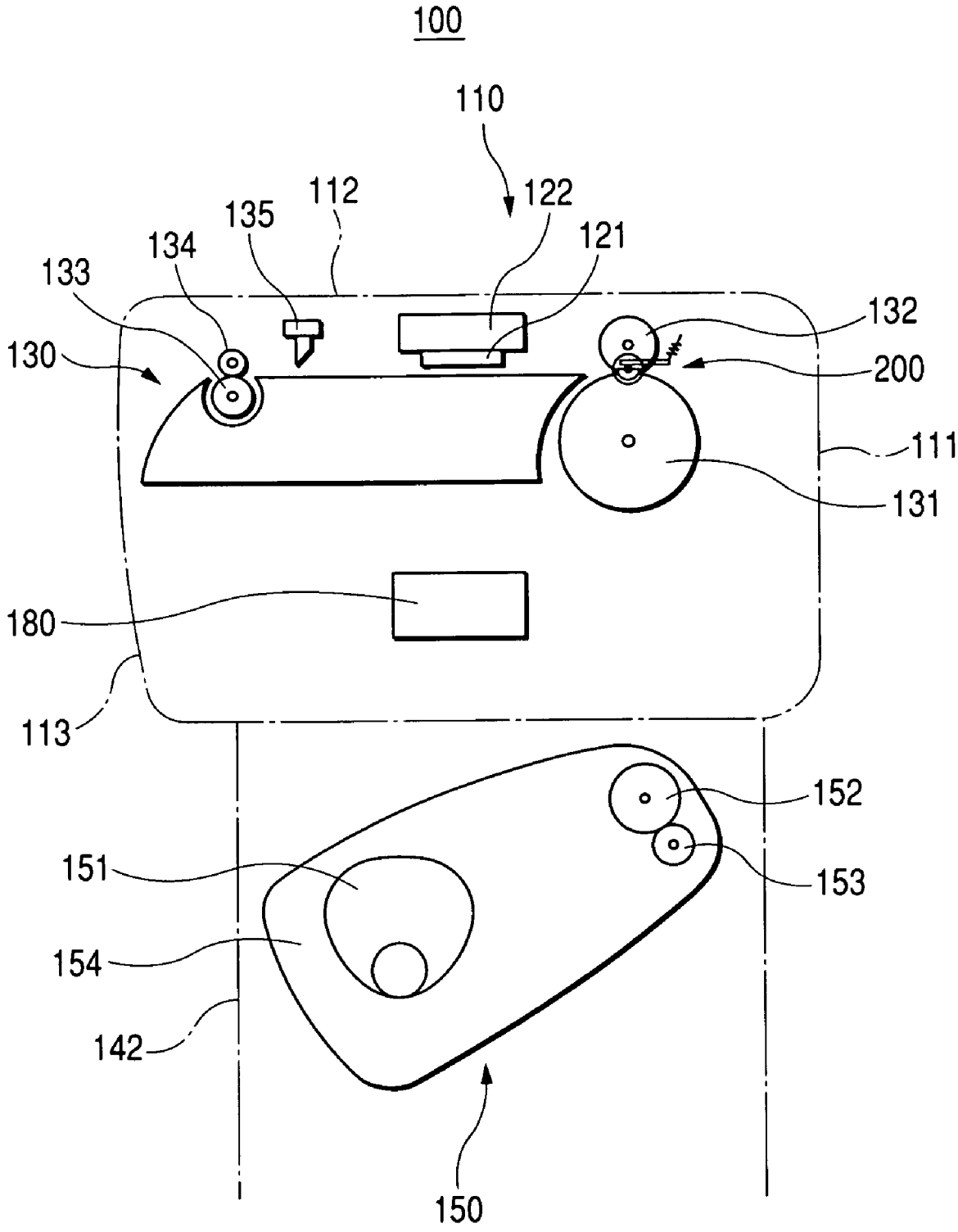
FIG. 15 is a cross section showing an essential portion of a printer according to a seventh embodiment of the invention.

In this embodiment, the friction applier 280 supports the outer peripheral face of the detection roller 270 at three points; however, the invention is not limited to this configuration. For example, the friction applier 280 may be configured to support the outer peripheral face at one point in the form of an arc or at four points in the form of two V-shaped grooves. Further, U-shaped grooves may be used instead of the V-shaped grooves. In addition, as is shown in FIG. 15, the transporting amount detector 200 in this embodiment is provided on the paper feeding roller 131; however, it may be provided on the ejection roller 133, in a space between the paper feeding roller 131 and the recording heads 121, at the upper stream portion of the paper feeding roller 131 in the transportation direction, or at the lower stream portion of the recording heads 121 in the transportation direction.

Each of the rotary encoder scales 221, 251, and 291 of the transporting amount detectors 200 in the respective embodiments described above is shaped like a disc, which is provided with a rotational axis hole at the center and a plurality of slits made at regular intervals along the circumference. For these rotary encoder scales 221, 251, and 291, the rotational axis hole may be made eccentrically because of a problem as to the accuracy of finishing. In such a case, the number of slits traversing the rotary encoders 222, 252, and 292 may differ even when the rotational angles of the rotary encoder scales 221, 251, and 291 are the same, which results in deterioration of the paper feed accuracy. An eighth embodiment of the invention provided with a detector that solves this problem will now be described with reference to FIG. 18A through FIG. 19.

Figure 18A:
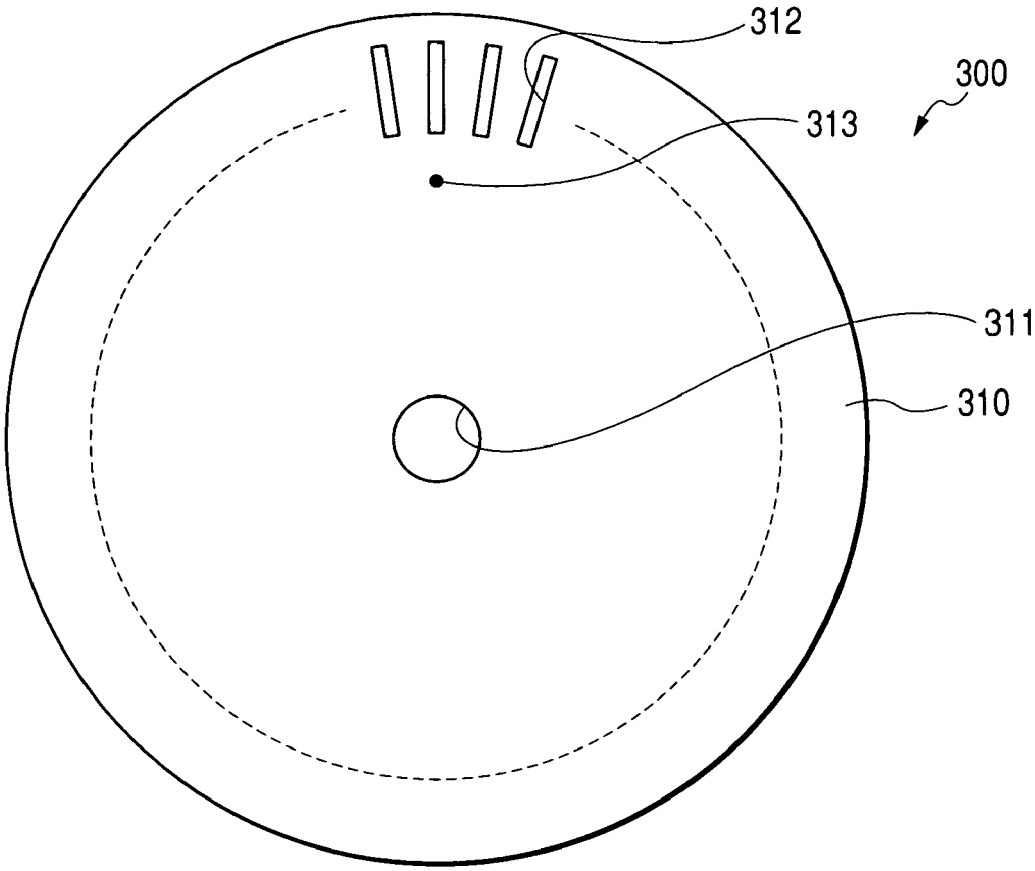
FIG. 18A is a plan view showing a rotary encoder scale in a detector according to an eighth embodiment of the invention.
Figure 18B:
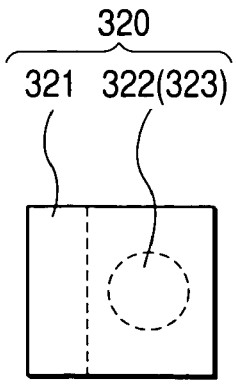
FIG. 18B is a side view showing a rotary encoder in the detector of FIG. 18A.
Figure 18C:
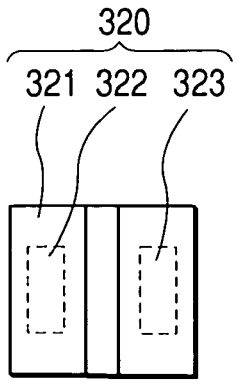
FIG. 18C is a front view showing the rotary encoder of FIG. 18B.

A detector 300 in this embodiment includes a rotary encoder scale 310 shown in FIG. 18A, and a rotary encoder 320 shown in FIG. 18B and FIG. 18C. The rotary encoder scale 310, made of plastic or the like, is shaped like a disc, which is provided with a rotational axis hole 311 at the center and a plurality of slits 312 made at regular intervals along the circumference. The rotary encoder 320 comprises a box-shaped main body 321 having an almost C-shaped cross section, in which a light emitting element 322 and a light receiving element 323 are provided oppositely. In this example, the rotational axis hole 311 in the rotary encoder scale 310 is fit into the detection roller 210, 230, 260, or 270. The main body 321 of the rotary encoder 320 is attached to the side frame, so that the light emitting element 322 and the light receiving element 323 are positioned at the both ends of a portion allocated for the slits 312 in the rotary encoder scale 310.

When configured in this manner, the rotary encoder scale 310 starts to rotate in association with rotations of the detection roller 210, 230, 260, or 270. Light emitted from the light emitting element 322 is blocked by spaces between the adjacent slits 312 but passes through the slits 312 to go incident on the light receiving element 323. Hence, by inputting a periodical signal outputted from the light receiving element 323, it is possible to control paper feed by finding a quantity of rotations of the rotary encoder scale 310, that is, a quantity of rotations of the follower roller 132.

Incidentally, the rotational axis hole 311 in the rotary encoder scale 310 may possibly be made eccentrically due to a problem as to the accuracy of finishing. In such a case, the center of the rotational axis hole 311 in the rotary encoder scale 310 is displaced from the center of the rotational axis of the detection roller 210, 230, 260, or 270. Hence, the number of slits 312 traversing a space between the light emitting element 322 and the light receiving element 323 may differ even when the rotational angle of the rotary encoder scale 310 is the same, which results in deterioration of the paper feed accuracy. This will be described more in detail with reference to FIG. 19.

Figure 19:
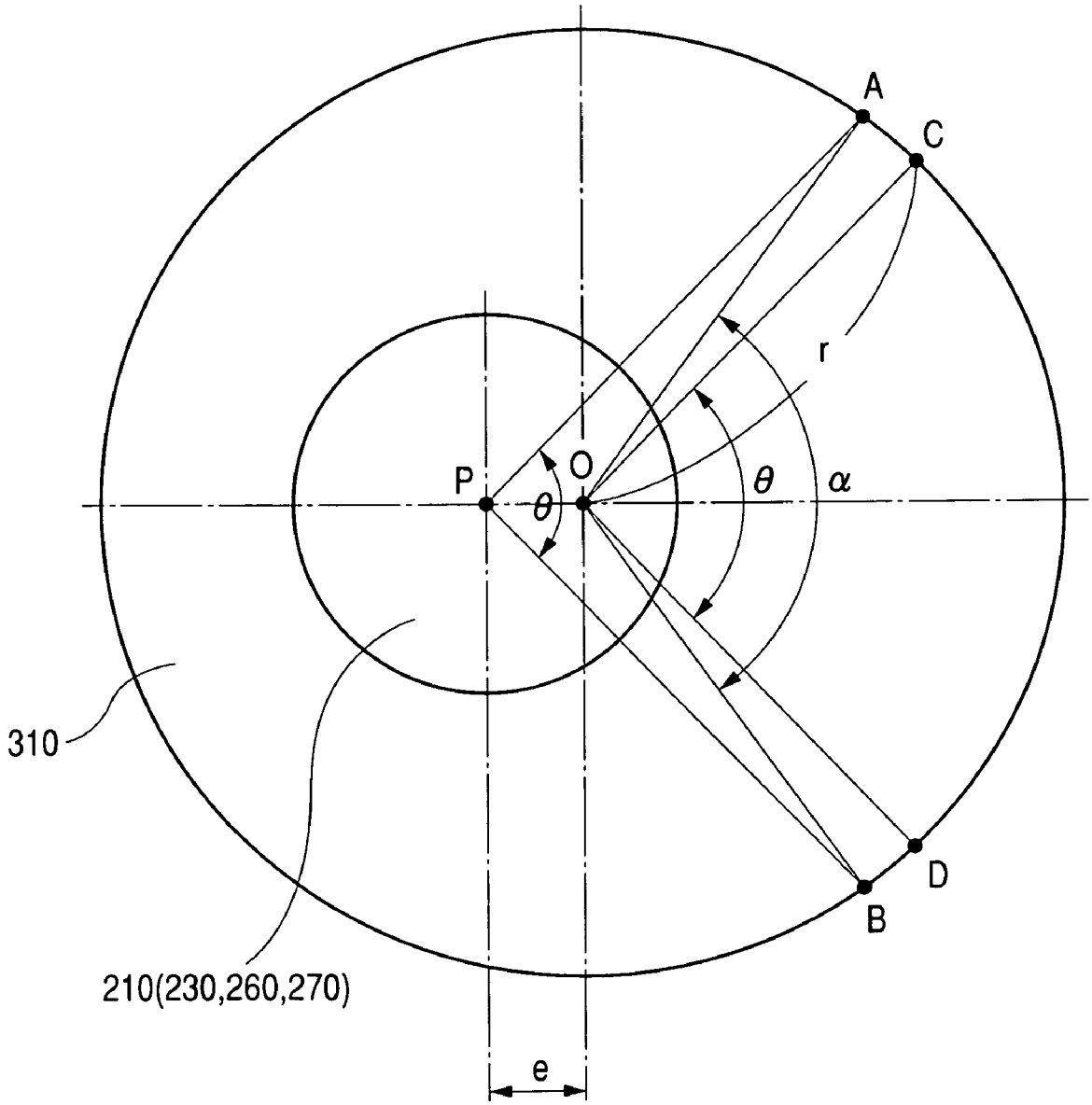
FIG. 19 is a view used to explain the influences from the eccentricity caused between the rotary encoder scale and a detection roller.

FIG. 19 is a view used to explain influences of displacement caused between the rotary encoder scale 310 and the detection roller 210, 230, 260, or 270. An error of the pitch circumferential length of the slits 312 resulted from eccentricity is a difference between the peripheral length AB in the case of rotations by an arbitrary angle θ about the rotational driving center P and the peripheral length CD corresponding to the angle θ when viewed from the center of the perfect circle O. The maximum error of the pitch circumferential length resulted from the eccentricity is derived from the relation as to the position at which OP divides the angle θ into halves (at a position shown in the drawing or a position at which the phase is shifted by π according to the circular method).

Let r be the radius of the perfect circle, α be a central angle AOB of the perfect circle with respect to the arc AB, and e be the distance of OP, then the maximum error of the pitch circumferential length, ϵ, is expressed by Equation (1) below, and Equation (2) below is found from the positional relation shown in the drawing:

$$\epsilon = AB - CD = r\alpha - r\theta \quad (1)$$

$$e \cdot \sin(\theta/2) = r \cdot \sin[(\alpha-\theta)/2] \quad (2)$$

Hence, in a range where $\sin[(\alpha-\theta)/2)] \approx (\alpha-\theta)/2$ is established by the circular method with small e, the maximum error of the pitch circumferential length, ϵ, resulted from the eccentricity is expressed by Equation (3) below as an approximate solution:

$$\epsilon = r(\alpha-\theta) = 2e \cdot \sin(\theta/2) \quad (3)$$

Hence, for each rotary encoder scale 310, the direction and a quantity of eccentricity have been measured previously. A dot mark 313 shown in the drawing, specifying the direction and a quantity of eccentricity, is indicated on the rotary encoder scale 310. With the use of the mark 313, the direction of eccentricity is specified, for example, by the indicated position (in the case of the drawing, in the 12 o'clock direction), and a quantity of eccentricity is specified, for example, by an indicated color (for instance, blue means within 5 μm, yellow means from 5 μm to 8 μm, and red means 8 μm or greater).

Further, for each of the detection rollers 210, 230, 260, and 270, the direction and a quantity of eccentricity have been measured previously. A line mark, specifying the direction and a quantity of the eccentricity, is indicated on the outer peripheral face at the edge of the detection roller 210, 230, 260, or 270. With the use of this mark, too, the direction of eccentricity is specified by the indicated position and a quantity of eccentricity is specified by an indicated color (for instance, blue means within 5 μm, yellow means from 5 μm to 8 μm, and red means 8 μm or greater). According to the configuration as described above, the rotary encoder scale 310 and the detection roller 210, 230, 260, or 270 can be selectively combined, so that the eccentricity of the rotary encoder scale 310 and the eccentricity of the detection roller 210, 230, 260, or 270 are cancelled out. Hence, when the rotational angle of the rotary encoder scale 310 is the same, so is the number of the slits 312 traversing a space between the light emitting element 322 and the light receiving element 323 without fail, which enables paper feed to be controlled at high accuracy.

Also, because the rotary encoder scale 310 is provided coaxially with the detection roller 210, 230, 260, or 270, it is insusceptible to influences from backlash of gears or the like. A quantity of paper feed based on the detection signal from the rotary encoder 320 therefore agrees with an actual quantity of paper feed by the paper feeding roller 131 and the follower roller 132, which enables paper feed to be controlled at high accuracy.

While the embodiment above employed the detector 300 using light, the invention is applicable when a detector using magnetism or capacitance is used instead. In addition, the mark 313, specifying the direction and a quantity of eccentricity, to be indicated on the rotary encoder scale 310 is not limited to a dot, and it can be of an arbitrary shape. The mark, specifying the direction and a quantity of eccentricity, to be indicated on the detection roller 210, 230, 260, or 270 is not limited to a line, either, and it can be of an arbitrary shape.

According to the detector 300 as has been described, the detection roller 210, 230, 260, or 270 and the rotary encoder scale 310 are provided in combination in such a manner that the eccentricity of the rotational center of the detection roller 210, 230, 260, or 270 and the eccentricity of the rotational center of the rotary encoder scale 310 provided coaxially with the detection roller 210, 230, 260, or 270 are cancelled out. Rotations of the paper feeding roller 131 that transports a sheet of paper can be thus detected directly by means of the rotary encoder scale 310, from which the eccentricity is eliminated completely. Transportation of a sheet of paper can be thus controlled at high accuracy.

Also, the direction and a quantity of eccentricity have been measured previously for the detection roller 210, 230, 260, or 270 and for the rotary encoder scale 310, which are indicated in the form of the mark 313 that specifies the direction of eccentricity by the indicated position and a quantity of eccentricity by an indicated color. The detection roller 210, 230, 260, or 270 and the rotary encoder scale 310 that can cancel out the eccentricities can be thus selected in a short time through visual confirmation. Hence, not only can a selection mistake of the detection roller 210, 230, 260, or 270 and the rotary encoder scale 310 be eliminated, but also a time needed for the assembly work can be shortened. It should be noted that the same advantages can be achieved even when the axes of the follower rollers 132 and 134 are extended to be used in place of the detection roller 210, 230, 260, or 270.

Figure 20:
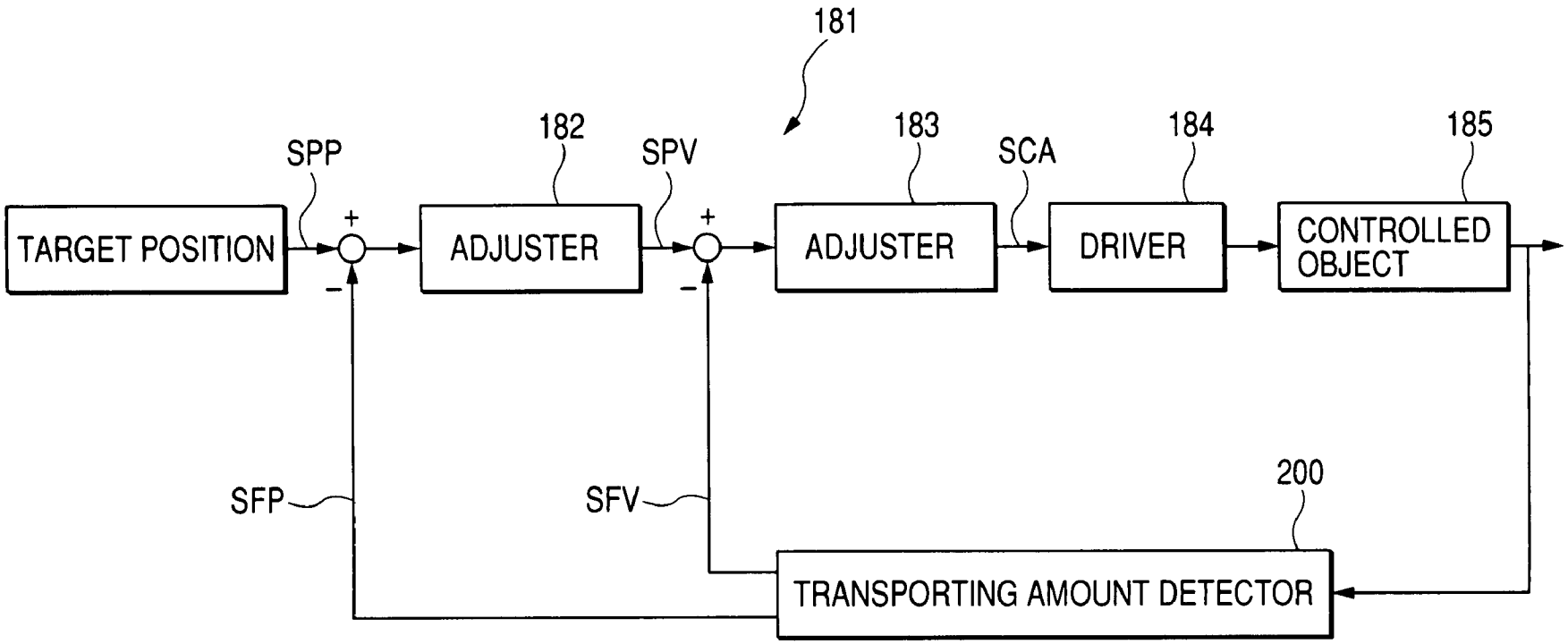
FIG. 20 is a block diagram showing a transportation controller in the printer of FIG. 1.

FIG. 20 shows a transportation controller 181 provided inside the controller 180 in the respective embodiments above. The transportation controller 181 is configured to perform feedback control on transportation of a sheet of paper, such as rolled paper R and a cut sheet P, with the use of the transporting amount detector 200. In other words, an adjuster 182 regulates a transportation position of a sheet of paper and a transportation velocity of a sheet of paper, and adjusts a transportation velocity SPV of a sheet of paper on the basis of a difference between a transportation target position SPP of a sheet of paper stored in a memory or the like and a current transportation position SFP of a sheet of paper fed back from the transporting amount detector 200.

Another adjuster 183 is configured to find a current state, a history in the past or the like of a sheet of paper, and adjusts a quantity of operation SCA, such as a current value needed to operate an object 185 to be controlled, such as a motor that drives the paper feeding roller 131, via a driver 184 on the basis of a difference between the transportation velocity SPV of a sheet of paper from the adjuster 182 and a current transportation velocity SFV of a sheet of paper fed back from the transportation quantity device 200.

Hence, a quantity of rotations of the motor is a quantity of rotations of the paper feeding roller 131, and a quantity of rotations of the paper feeding roller 131 is a quantity of transportation of a sheet of paper. By detecting a quantity of rotations of the detection roller 210, 230, 260, or 270, which is capable of detecting the transportation directly, with the use of the detector 220, 250, or 300, it is possible to control transportation of a sheet of paper at high accuracy without being affected by any error that may occur during the transportation. By directly detecting and controlling a quantity of transportation of a sheet of paper in this manner, it is possible to transport a sheet of paper at markedly improved accuracy without being affected by slipping, that is, by canceling the influences from a change in back tension or front resistance of a sheet of paper and thereby eliminating influences of a sheet of paper that differ in each kind. Further, because the detection rollers 210, 230, 260, and 270 do not have to have a high frictional coefficient, the detection rollers 210, 230, 260, and 270 can be manufactured at low costs.

As are shown in FIG. 1 and FIG. 2, the legs 140 include two supporting pillars 142 each having traveling rollers 141. The main body 110 is placed on the top portions of the supporting pillars 142 and fastened with screws. By providing the traveling rollers 141 to the supporting pillars 142, the user is able to move the heavy main body 110 to a desired location smoothly for installation.

Figure 21:
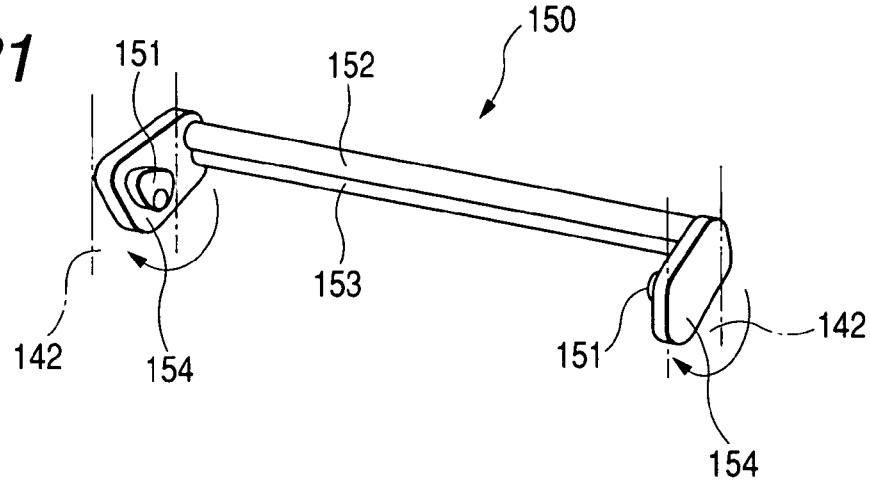
FIG. 21 is a perspective view showing a paper feeder in the printer of FIG. 1.

As are shown in FIG. 1 and FIG. 3, the paper feeder 150 is provided at the bottom of the main body 110 between the legs 140, and includes a pair of supporters 151 to support the both ends of rolled paper R, and a delivery roller 152 and a pinch roller 153 that together feed and transport rolled paper R. Further, the paper feeder 150 includes a pair of arm portions 154, to which the supporters 151 are fixed, and by which the both ends of the respective delivery roller 152 and the pinch roller 153 are axially supported. The paper feeder 150 configured in this manner will no now be described in detail with reference to FIG. 21.

The pair of supporters 151 is attached fixedly to the opposing faces of the pair of the oppositely placed arm portions 154. The pair of supporters 151 houses bearings to axially support the both ends of a spindle 155, used to support rolled paper R by being inserted through the inner peripheral portion C of roller paper R shown in FIG. 22B, to be free to rotate.

Figure 22A:
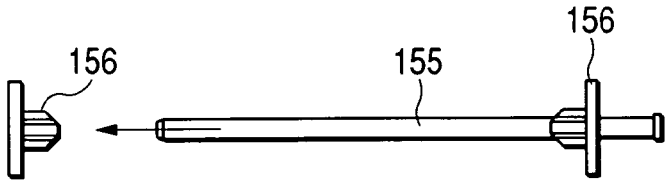
FIG. 22A through FIG. 27 are views detailing the use procedure of the printer of FIG. 1.
Figure 22B:
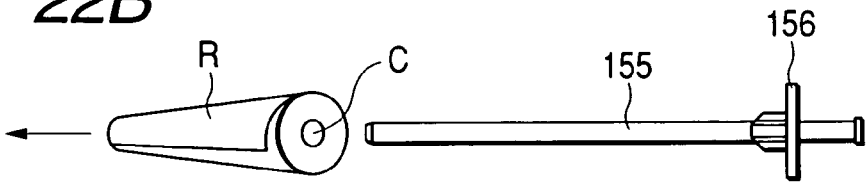
Figure 22C:
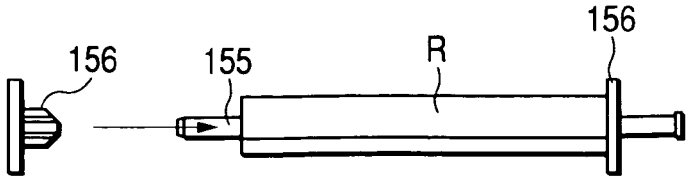
Figure 23A:
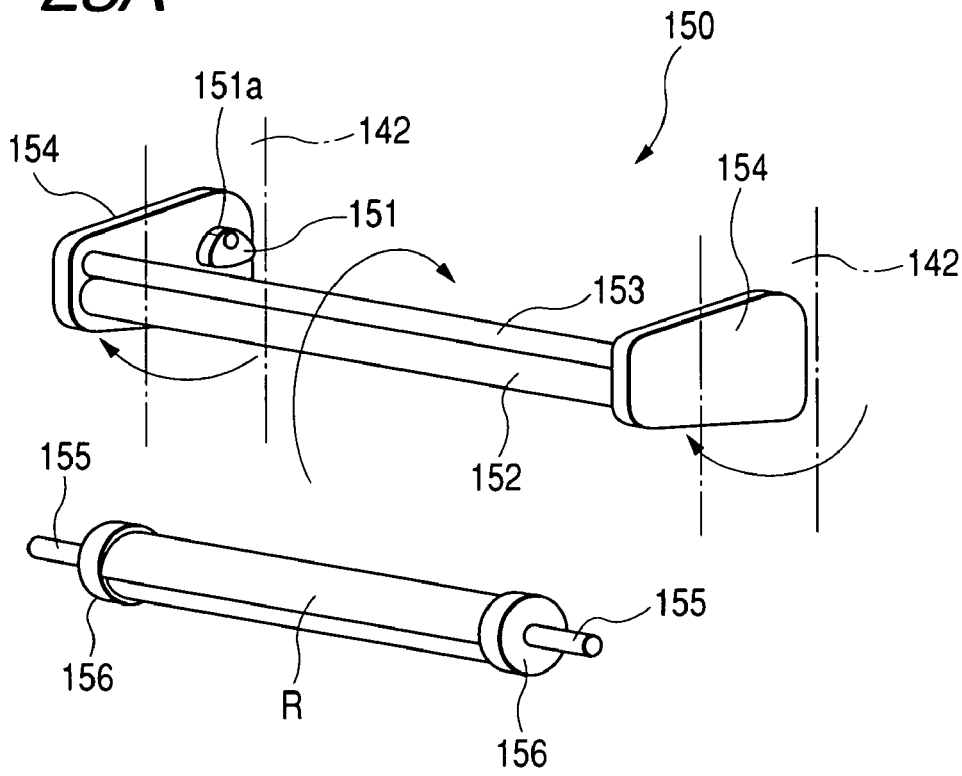
Figure 23B:
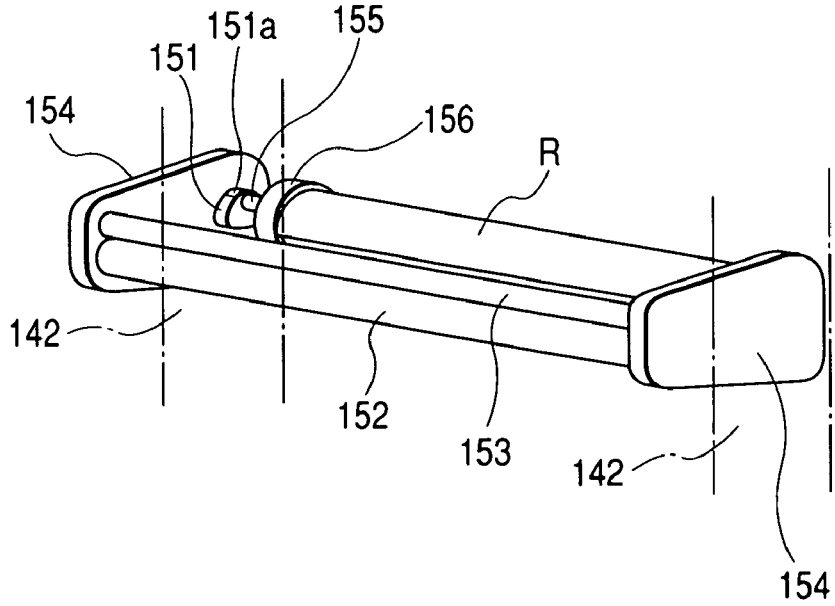

In other words, as are shown in FIG. 22A and FIG. 22C, in the spindle 155 is fit roller paper R at the center, and a pair of flange-shaped rolled paper holders 156 is fit in at the both ends of the rolled paper R, while as is shown in. FIG. 23B, the spindle 155 is put across the pair of supporters 151. The user can complete loading of rolled paper R by merely lifting up rolled paper R to which the spindle 155 is attached, and by fitting the both ends of the spindle 155 in the pair of supporters 151. The number of steps needed to set rolled paper R can be thus reduced markedly.

The delivery roller 152 and the pinch roller 153 are axially supported on the opposing faces of the pair of oppositely placed arm portions 1541 at the both ends to be free to rotate. In other words, the delivery roller 152 and the pinch roller 153 are provided across the pair of arm portions 154. The both ends of the delivery roller 152 are axially supported at constant points on the opposing faces of the pair of arm portions 154. However, to enable the pinch roller 153 to abut on and to be spaced apart from the delivery roller 152, the both axial ends of the pinch roller 153 are axially supported movably, for example, within grooves made in the opposing faces of the pair of arm portions 154. The pinch roller 153, at positions to abut on and to be spaced apart from the delivery roller 152, is locked by a locking mechanism that uses, for example, a stopping member, an urging member and the like provided on the opposing faces of the arm portions 154.

The user is able to pull out the leading edge of rolled paper R with ease due to the bearings housed in the supporters 151. Moreover, the user is able to insert and pinch the leading edge of rolled paper R in a space between the delivery roller 152 and the pinch roller 153 with ease due to the moving mechanism of the pinch roller 153. Hence, the number of steps needed to set rolled paper R can be reduced markedly.

The pair of arm portions 154 is attached to the opposing faces of the two supporting pillars 142 of the legs 140 to be free to rotate in a direction indicated by an arrow. Rotations of the pair of arm portions 154 are positioned between the setting position of rolled paper R shown in FIG. 23A and the feeding position of rolled paper R shown in FIG. 21, by being locked by the locking mechanism using the stopping member, the urging member and the like provided, for example, on the opposing faces of the supporting pillars 142.

To be more specific, when the pair of arm portions 154 is rotated to the setting position of rolled paper R, the delivery roller 152 and the pinch roller 153 pop up to the front face of the printer 100, and when the pair of arm portions 154 is rotated to the feed position of rolled paper R, the delivery roller 152 and the pinch roller 153 come around to the backside of the printer 100 to be connected to a transportation path of rolled paper R.

The user is thus able to insert and pinch the leading edge of rolled paper R in a space between the delivery roller 152 and the pinch roller 153 at the normal standing position on the front face side of the printer 100 without having to go around the backside of the printer 100. The number of steps needed to set rolled paper R can be thus reduced markedly.

In the embodiments described above, the pair of supporters 151 is attached fixedly to the opposing faces the pair of oppositely placed arm portions 154, and thereby rotates together with the arm portions 154. It should be appreciated, however, that the same advantages can be achieved by attaching the pair of supporters 151 fixedly to axes coaxial with the rotational axes of the arm portions 154 attached to the opposing faces of the two supporting pillars 142 of the legs 140. In short, the supporters 151 may be fixed to a constant position always regardless of the rotations of the arm portions 154.

The use procedure of the printer 100 configured as described above will now be described with reference to FIG. 22A through FIG. 27. As is shown in FIG. 22A, the user first pulls out one of the pair of rolled paper holders 156 fit in the spindle 155 from one end of the spindle 155. Then, as is shown in FIG. 22B, the user inserts one end of the spindle 155 into the axial hole C of the rolled paper R from one end to penetrate through.

Further, as is shown in FIG. 22C, the user fits one end of the axial hole C of rolled paper R in the other rolled paper holder 156 that is inserted in and fixed to the other end of the spindle 155 until the former abuts on the latter. Subsequently, the user inserts one rolled paper holder 156 from one end of the spindle 155 to be fit in the axial hole C of rolled paper R at the other end. Roll paper R is thus able to rotate together with the spindle 155.

The user then pulls, for example, the delivery roller 152 forward to cause the arm portions 154 to pivot. The arm portions 154, currently being positioned at the feeding position of rolled paper R (see FIG. 21), are thus re-positioned at the setting position of rolled paper R shown in FIG. 23A to be locked. The user lifts up the rolled paper R, in which the spindle 155 is inserted, above the supporters 151, and as is shown in FIG. 23B, the user fits the both ends of the spindle 155 into recesses 151*a* in the respective supporters 151. Because the user can complete the loading of rolled paper R by merely fitting the both ends of the spindle 155 into the pair of supporters 151 in this manner, the number of steps needed to set rolled paper R can be reduced markedly.

Figure 24A:
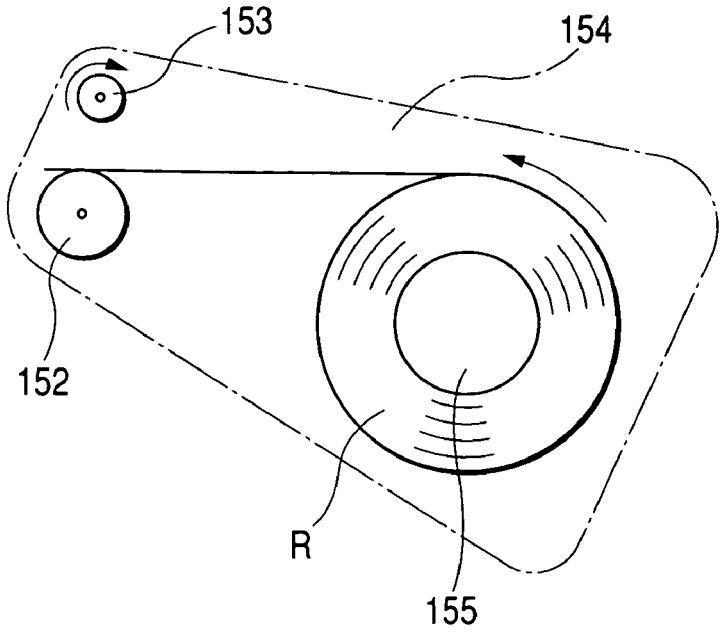
Figure 24B:
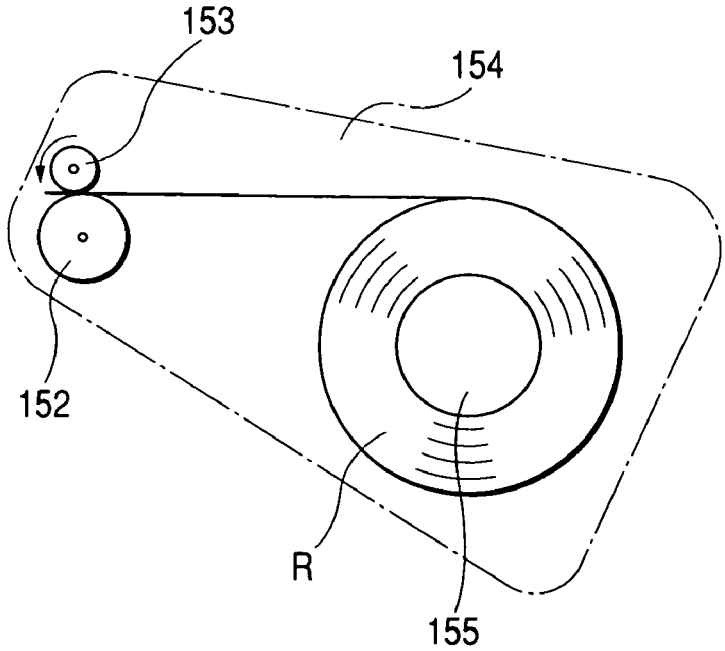

As is shown in FIG. 24A, the user then lifts up the pinch roller 153 to be spaced apart from the delivery roller 152 and locks the pinch roller 153. The user pulls the leading edge of rolled paper R forward and inserts the same in a space between the pinch roller 153 and the delivery roller 152. Subsequently, as is shown in FIG. 24B, the user pushes down the pinch roller 153 to abut on the delivery roller 152, so that the leading edge of the rolled paper R is pinched between the pinch roller 153 and the delivery roller 152. As has been described, because the user is able to pull out the leading edge of rolled paper R and pinch the same between the delivery roller 152 and the pinch roller 153 at the normal standing position on the front face side of the ink jet printer 100, the number of steps needed to set rolled paper R can be reduced markedly.

Figure 25A:
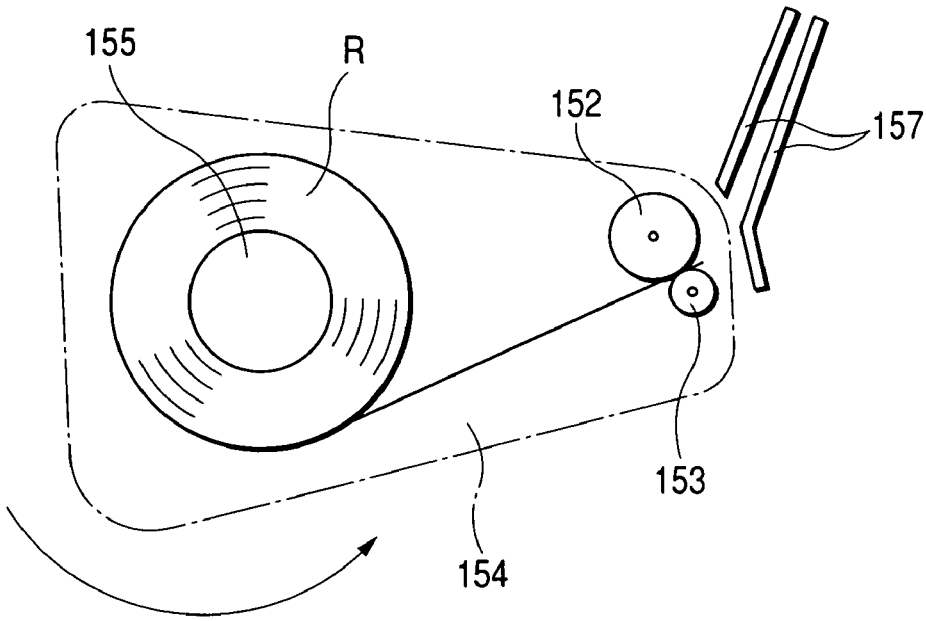

Subsequently, as is shown in FIG. 25A, the user pushes, for example, the delivery roller 152 inward to cause the arm portions 154 to pivot, and the arm portions 154, currently being positioned at the setting position of rolled paper R, are then re-positioned to the feeding position of rolled paper R. The leading edge of rolled paper R pinched between the pinch roller 153 and the delivery roller 152 is thus positioned at the entrance of the paper feed guide 157.

Figure 25B:
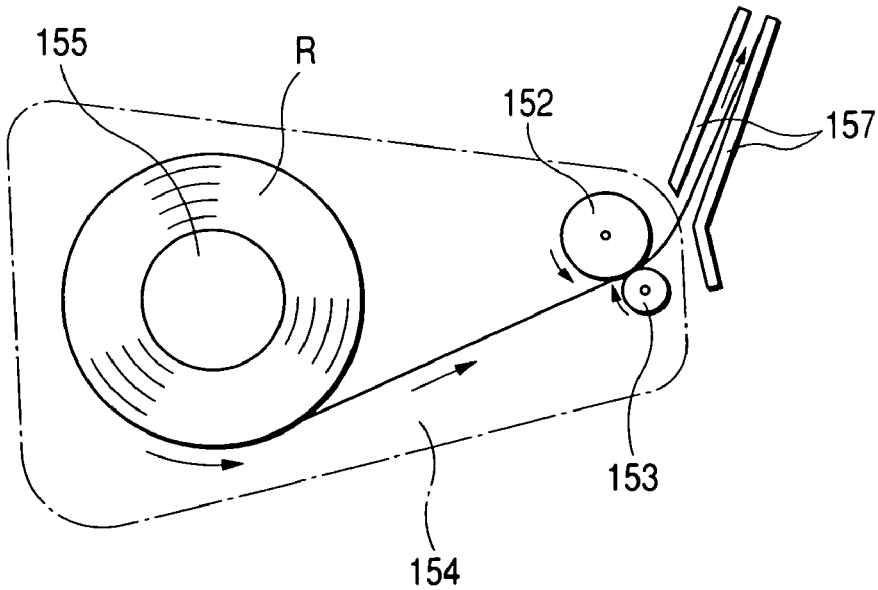

When the user manipulates the control panel 170 to activate the printer 100 at this point, as is shown in FIG. 25B, the delivery roller 152 starts to rotate. The rolled paper R pinched between the pinch roller 153 and the delivery roller 152 is then guided by the paper feed guide 157 to be fed to the recording section 120 provided above.

Figure 26:
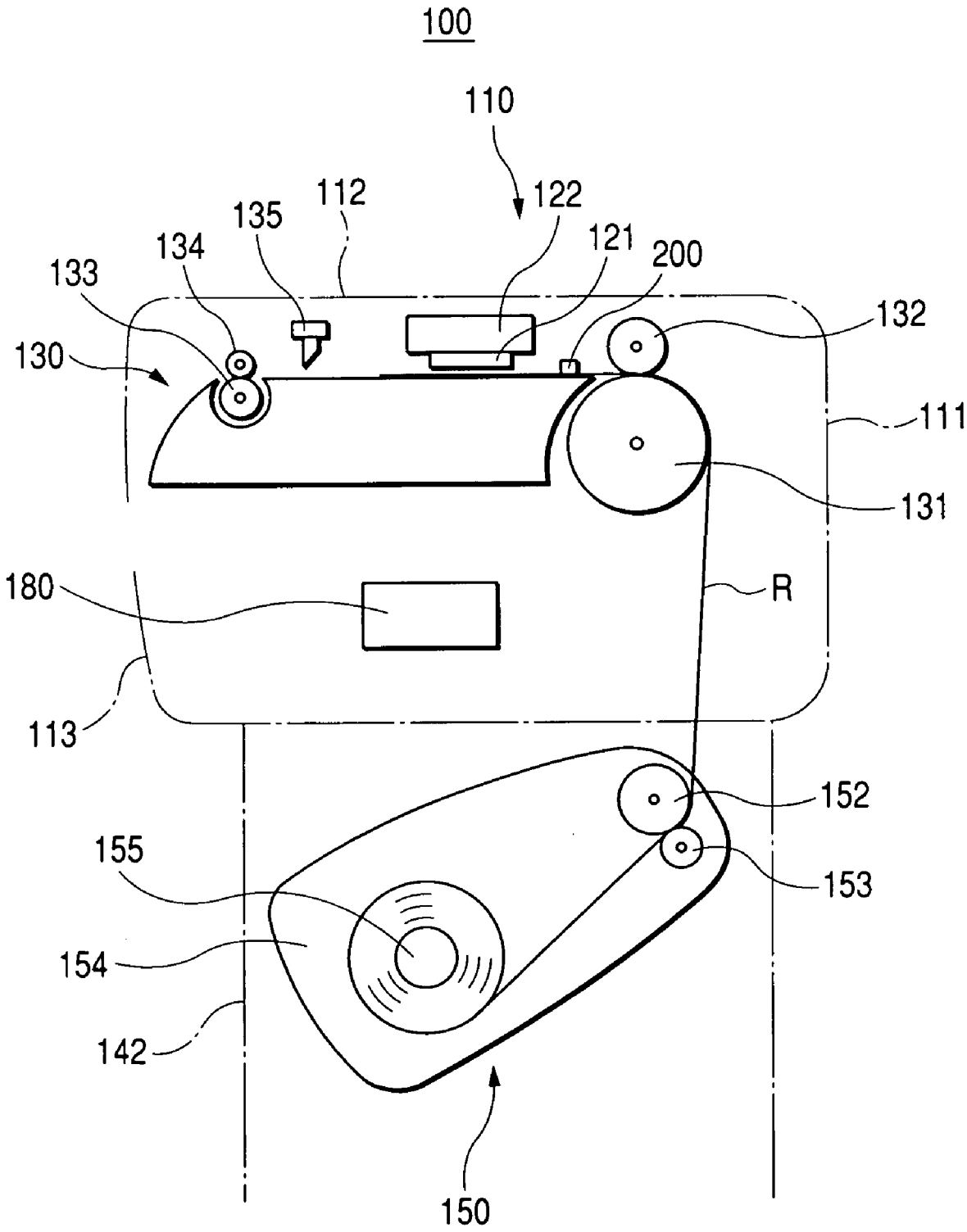
Figure 27:
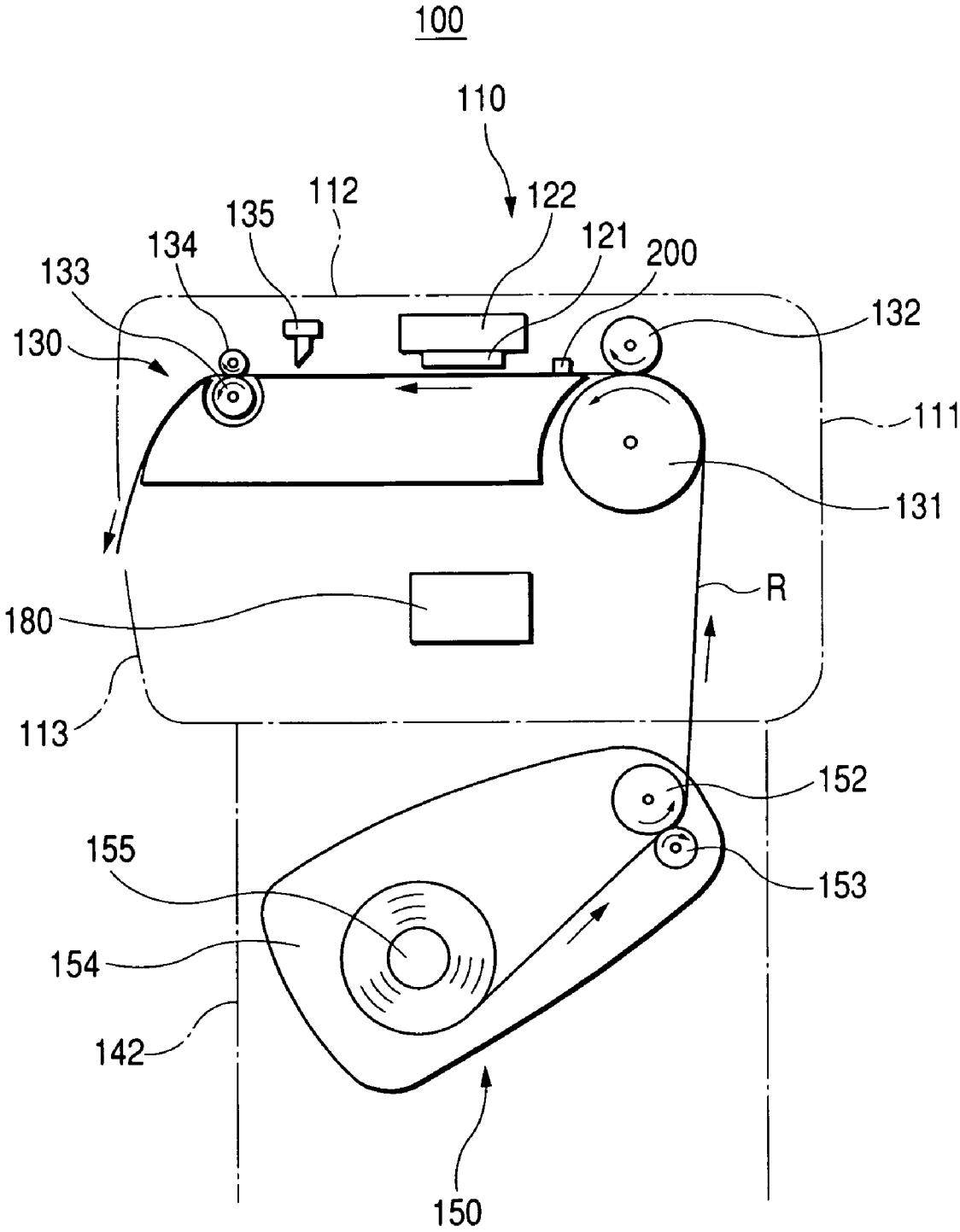

Then, as is shown in FIG. 26, on the rolled paper R that is transported in the secondary scanning direction by being pinched between the paper feeding roller 131 and the follower roller 132, specific information is recorded with ink droplets ejected from the recording heads 121 that move in the primary scanning direction. In this instance, because transportation of the rolled paper R is controlled at high accuracy by the transporting amount detector 200, the recording accuracy on the rolled paper R can be maintained high. When the recording ends, as is shown in FIG. 27, the rolled paper R is cut by the cutter 135, and pinched between the ejection roller 133 and the follower roller 134 to be ejected.

The invention is applicable to any type of recording apparatus, such as a facsimile machine and a copying machine, provided that it is equipped with the medium transporting device. Further, applications of the invention are not limited to a recording apparatus. The invention is also applicable to an apparatus equipped with a color material ejection head used when manufacturing color filters for use, for example, in a liquid crystal display, an electrode material (electrical conductive paste) ejection head used when forming electrodes in an organic EL display, an FED (Field Emission Display) or the like, a bio-organic material ejection head used when manufacturing bio-chips, and a sample spraying head used as a micro-pipette, in terms of a liquid ejection device that ejects, instead of ink, liquid adequate for the purpose from a liquid ejection head to a target medium.

What is claimed is:

1. An apparatus for transporting a medium, comprising:

a flat supporting member, defining a transporting path adapted to support the medium thereon;

a detection roller, opposing the flat supporting member, the detection roller being adapted to be directly brought into contact with the medium and to be rotated in accordance with the transportation of the medium;

a detector, which detects a rotation amount of the detection roller;

a controller, which controls the transportation of the medium in accordance with the rotation amount;

a first roller, which transports the medium toward the transporting path; and a second roller, which ejects the medium transported from the transporting path to outside of the apparatus, and an urging member, which urges the detection roller toward flat supporting member, so that the detection roller is movable in a direction orthogonal to both of a direction that the medium is transported and an axial direction of the detection roller, wherein the detection roller is disposed between the first roller and the second roller.

2. The apparatus as set forth in claim 1 further comprising a friction applier, which applies a frictional force onto an outer periphery of the detection roller.

3. The apparatus as set forth in claim 2, wherein the friction applier is configured so as to restrict a movement of the detection roller in a radial direction thereof.

4. The apparatus as set forth in claim 3, wherein the friction applier comprises a press member which is pressed against the detection roller.

5. The apparatus as set forth in claim 4, wherein the press member is pressed against the detection roller in a point-contact manner.

6. The apparatus as set forth in claim 4, wherein the friction applier comprises a support member which supports the detection roller so as to restrict a movement thereof in a direction that the medium is transported.

7. The apparatus as set forth in claim 6, wherein the support member supports the detection roller at at least two points.

8. The apparatus as set forth in claim 6, wherein the support member is formed with a groove having a V-shaped cross section for supporting the detection roller.

9. The apparatus as set forth in claim 4, wherein the friction applier comprises an urging member which urges the press member against the detection roller.

10. The apparatus as set forth in claim 1, wherein: the detection roller has a first part which is directly brought into contact with the medium and a second part which is rotatably supported by a support member; and an outer circumferential face of the first part is flush with an outer circumferential face of the second part.

11. The apparatus as set forth in claim 1, wherein the controller controls the transportation of the medium in a feedback manner.

12. The apparatus as set forth in claim 1, wherein the detector comprises a rotary encoder scale.

13. The apparatus as set forth in claim 12, wherein:

the detection roller is provided with a first mark indicating a direction and an amount of a first eccentricity of the detection roller which have been measured in advance; and the rotary encoder scale is provided with a second mark indicating a direction and an amount of a second eccentricity of the rotary encoder scale which have been measured in advance.

14. The apparatus as set forth in claim 13, wherein:

the direction of the first eccentricity is indicated by a position of the first mark, and the amount of the first eccentricity is indicated by a color of the first mark; and the direction of the second eccentricity is indicated by a position of the second mark, and the amount of the second eccentricity is indicated by a color of the second mark.

15. The apparatus as set forth in claim 13, wherein the detection roller and the rotary encoder scale are arranged so as to cancel the first eccentricity and the second eccentricity with reference to the first mark and the second mark.

16. The apparatus as set forth in claim 12, wherein a diameter of the detection roller is smaller than a diameter of the rotary encoder scale.

17. An apparatus for transporting a medium, comprising:

a transporting path, through which the medium is transported;

a first roller, which transports the medium toward the transporting path;

a second roller, which ejects the medium transported from the transporting path to outside of the apparatus;

a detection roller, being in contact with the first roller and rotated in accordance with the transportation of the medium;

a detector, which detects a rotation amount of the detection roller;

a controller, which controls the transportation of the medium in accordance with the rotation amount; and an urging member which urges the detection roller against the first roller, and comprises at least one rotary member which is rotatable in accordance with the rotation of the detection roller.

18. The apparatus as set forth in claim 17, wherein the urging member comprises at least four rotary members disposed so as to come in contact with two portions on the detection roller in an axial direction thereof and with two portions on the detection roller in a circumferential direction thereof.

19. The apparatus as set forth in claim 17, further comprising a friction applier, which applies a frictional force onto an outer periphery of the detection roller.

20. The apparatus as set forth in claim 19, wherein the friction applier is configured so as to restrict a movement of the detection roller in a radial direction thereof.

21. The apparatus as set forth in claim 20, wherein the friction applier comprises a press member which is pressed against the detection roller.

22. The apparatus as set forth in claim 21, wherein the press member is pressed against the detection roller in a point-contact manner.

23. The apparatus as set forth in claim 21, wherein the friction applier comprises a support member which supports the detection roller so as to restrict a movement thereof in a direction that the medium is transported.

24. The apparatus as set forth in claim 23, wherein the support member supports the detection roller at at least two points.

25. The apparatus as set forth in claim 23, wherein the support member is formed with a groove having a V-shaped cross section for supporting the detection roller.

26. The apparatus as set forth in claim 21, wherein the friction applier comprises an urging member which urges the press member against the detection roller.

27. A liquid ejection apparatus, comprising:

a flat supporting member, defining a transporting path adapted to support a medium thereon;

a liquid ejection head, operable to eject a liquid droplet toward the medium at a liquid ejection point situated on the transporting path;

a first roller, which transports the medium toward the liquid ejection point;

a second roller, which ejects the medium transported from the liquid ejection point to outside of the apparatus;

at least one detection roller, opposing the flat supporting member, the at least on detection roller being adapted to be directly brought into contact with the medium and to be rotated in accordance with the transportation of the medium, the at least one detection roller being disposed between the first roller and the second roller, an urging member, which urges the detection roller toward the flat supporting member, so that the detection roller is movable in a direction orthogonal to both of a direction that the medium is transported and an axial direction of the detection roller;

a detector, which detects a rotation amount of the detection roller; and a controller, which controls the transportation of the medium in accordance with the rotation amount.

28. A recording apparatus, comprising: a flat supporting member, defining a transporting path adapted to support a medium thereon;

a recording head, operable to record information on a medium at a recording point situated on the transporting path;

a first roller, which transports the medium toward the recording point;

a second roller, which ejects the medium transported from the recording point to outside of the apparatus;

at least one detection roller, opposing the flat supporting member, the at least one detection roller being adapted to be directly brought into contact with the medium and to be rotated in accordance with the transportation of the medium, the at least one detection roller being disposed between the first roller and the second roller, an urging member, which urges the detection roller toward the flat supporting member, so that the detection roller is movable in a direction orthogonal to both of a direction that the medium is transported and an axial direction of the detection roller;

a detector, which detects a rotation amount of the detection roller; and a controller, which controls the transportation of the medium in accordance with the rotation amount.

29. An apparatus for transporting a medium, comprising:

a transporting path, through which the medium is transported;

a first roller, which transports the medium toward the transporting path;

a second roller, which ejects the medium transported from the transporting path to outside of the apparatus;

a detection roller, being in contact with the second roller and adapted to be rotated in accordance with at least one of the rotation of the second roller and the transportation of the medium;

a detector, which detects a rotation amount of the detection roller;

a controller, which controls the transportation of the medium in accordance with the rotation amount; and an urging member, which urges the detection roller against the second roller, and comprises at least one rotary member which is rotatable in accordance with the rotation of the detection roller.

30. The apparatus as set forth in claim 29, further comprising a friction applier, which applies a frictional force onto an outer periphery of the detection roller.

31. The apparatus as set forth in claim 30, wherein the friction applier is configured so as to restrict a movement of the detection roller in a radial direction thereof.

32. The apparatus as set forth in claim 31, wherein the friction applier comprises a press member which is pressed against the detection roller.

33. The apparatus as set forth in claim 32, wherein the press member is pressed against the detection roller in a point-contact manner.

34. The apparatus as set forth in claim 32, wherein the friction applier comprises a support member which supports the detection roller so as to restrict a movement thereof in a direction the medium is transported.

35. The apparatus as set forth in claim 34, wherein the support member supports the detection roller at least two points.

36. The apparatus as set forth in claim 34, wherein the support member is formed with a groove having a V-shaped cross section for supporting the detection roller.

37. The apparatus as set forth in claim 32, wherein the friction applier comprises an urging member which urges the press member against the detection roller.

38. A liquid ejection apparatus, comprising:

a liquid ejection head, operable to eject a liquid droplet toward a medium at a liquid ejection point;

a first roller, which transports the medium toward the liquid ejection point;

a second roller, which ejects the medium transported from the liquid ejection point to outside of the apparatus;

a detection roller, being in contact with the first roller and rotated in accordance with the transportation of the medium;

a detector, which detects a rotation amount of the detection roller;

a controller, which controls the transportation of the medium in accordance with the rotation amount; and an urging member which urges the detection roller against the first roller, and wherein the urging member comprises at least one rotary member which is rotatable in accordance with the rotation of the detection roller.

39. A recording apparatus, comprising:

a recording head, operable to record information on a medium at a recording point;

a first roller, which transports the medium toward the recording point;

a second roller, which ejects the medium transported from the recording point to outside of the apparatus;

a detection roller, being in contact with the first roller and rotated in accordance with the transportation of the medium;

a detector, which detects a rotation amount of the detection roller;

a controller, which controls the transportation of the medium in accordance with the rotation amount; and an urging member which urges the detection roller against the first roller, and wherein the urging member comprises at least one rotary member which is rotatable in accordance with the rotation of the detection roller.

* * * * *